US006361283B1

(12) United States Patent
Ota et al.

(10) Patent No.: US 6,361,283 B1
(45) Date of Patent: Mar. 26, 2002

(54) DISPLACEMENT CONTROL VALVE

(75) Inventors: Masaki Ota; Masahiro Kawaguchi; Ken Suitou; Ryo Matsubara, all of Kariya; Hiroyuki Nishinosono; Kouji Watanabe, both of Fujisawa, all of (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/588,742

(22) Filed: Jun. 6, 2000

(30) Foreign Application Priority Data

Jun. 7, 1999 (JP) ..... 11-159395

(51) Int. Cl.[7] ..... F04B 1/26
(52) U.S. Cl. ..... 417/222.2
(58) Field of Search ..... 417/222.2, 269

(56) References Cited

U.S. PATENT DOCUMENTS 4,606,705 A 8/1986 Parekh
5,145,326 A 9/1992 Kimura et al.
RE35,672 E 11/1997 Taguchi
5,702,235 A 12/1997 Hirota et al.
6,062,823 A * 5/2000 Kawaguchi et al. ..... 417/222.2
6,062,824 A * 5/2000 Kimura et al. ..... 417/222.2
6,146,106 A * 11/2000 Suitou et al. ..... 417/222.2
6,234,763 B1 * 5/2001 Ota et al. ..... 417/222.2

FOREIGN PATENT DOCUMENTS

JP 5-099136 4/1993

* cited by examiner

*Primary Examiner*—Michael Koczo
(74) *Attorney, Agent, or Firm*—Morgan & Finnegan, LLP

(57) ABSTRACT

A control valve controls the displacement of a variable displacement type compressor. The compressor has a crank chamber, a bleed passage, and a supply passage. An outlet valve portion located on the bleed passage to control the opening of the bleed passage. An inlet valve portion is located on the supply passage to control the opening of the supply passage. A transmission rod extends between the outlet valve portion and the inlet valve portion to connect the outlet valve portion to the inlet valve portion. The transmission rod moves axially. A through hole is located in the inlet valve portion to receive a part of the transmission rod. The through hole constitutes a part of the supply passage. A clearance is formed between the transmission rod and the through hole to constantly connect the discharge pressure zone to the crank chamber.

23 Claims, 11 Drawing Sheets

DISPLACEMENT CONTROL VALVE

BACKGROUND OF THE INVENTION

The present invention relates to a displacement control valve for variable displacement compressors, more specifically, to a control valve that controls the amount of gas flow to and from a crank chamber to vary the compressor displacement.

In a typical variable displacement compressor, the inclination of the swash plate varies in accordance with the pressure in a crank chamber (crank pressure Pc). To control the crank pressure Pc, either the flow rate of refrigerant gas delivered to the crank chamber or the flow rate of refrigerant gas released from the crank chamber must be controlled.

The crank chamber is connected to a discharge chamber by a supply passage and to a suction chamber by a bleeding passage. To control the flow rate of gas delivered to the crank chamber, an inlet control valve is located in the supply passage. The inlet control valve adjusts the flow rate of refrigerant gas supplied to the crank chamber from the discharge chamber, thereby setting the crank pressure Pc to a desired level.

To control the flow rate of gas released from the crank chamber, an outlet control valve is located in the bleeding passage. When a piston compresses refrigerant gas in an associated cylinder bore, refrigerant gas in the cylinder bore leaks into the crank chamber between the surface of the piston and the wall of the cylinder bore. The leaking gas is referred to as blowby gas. The blowby gas increases the pressure of the crank chamber. The outlet control valve adjusts the flow rate of refrigerant gas flowing from the crank chamber to the suction chamber to set the crank pressure Pc to a desired level.

One advantage of an inlet control valve is that the crank pressure Pc can be increased quickly. However, to maintain the crank pressure Pc, the flow rate of refrigerant gas flowing into the crank chamber must be the same as that flowing out of the crank chamber. In other words, a relatively great amount of gas is required to maintain the crank pressure Pc.

An outlet control valve, on the other hand, has a relatively simple structure and automatically controls the valve opening size. One advantage of an outlet control valve is that only a small supply of gas is required to maintain the pressure in the crank chamber. However, an outlet control valve takes a relatively long time to raise crank pressure Pc. Therefore, a compound control valve, which has advantages of inlet and outlet control valves, has been introduced.

Japanese Unexamined Patent Publication No. 5-99136 discloses a compound control valve having an inlet valve portion, an electromagnetic actuator, an outlet valve portion and a transmission rod. The inlet valve portion includes an inlet valve body and a spring. The inlet valve body is moved by the rod to open and close a supply passage. The spring urges the inlet valve body downward, or in a direction closing the supply passage. The electromagnetic actuator urges the rod upward against the force of the spring. The outlet valve portion is located between the inlet valve portion and the actuator and is coupled to the actuator.

The outlet valve portion includes a diaphragm and an annular outlet valve body. The outlet valve body adjusts the opening size of a bleeding passage, which connects the crank chamber to a suction chamber, based on the suction pressure Ps of the compressor. The outlet valve body is engaged with a step formed on the transmission rod. When the rod is moved downward, the outlet valve body is moved integrally with the rod. When the rod is moved upward, the outlet valve body contacts a valve seat formed in the valve housing to close the bleeding passage. If the rod is moved further upward, the rod does not move the outlet valve body while moving the inlet valve body upward. In other words, the rod functions as a guide to support the outlet valve body.

The control valve sets a target suction pressure based on the level of a current supplied to the actuator. When the crank pressure Pc needs to be quickly increased, a current, the level of which is greater than a predetermined level, is supplied to the actuator. Accordingly, the actuator moves the rod upward to cause the outlet valve body to close the bleeding passage. The actuator further moves the rod upward to quickly move the inlet valve body upward to open the inlet valve portion. In other words, the control valve functions as an outlet control valve when the compressor is operating in a normal state and functions as an inlet control valve when the crank pressure Pc needs to be raised quickly. Therefore, during normal operation, the control valve requires only a small flow rate of refrigerant gas to maintain the crank pressure Pc, and when necessary, the crank pressure Pc can be changed quickly.

The variable displacement compressor of the above publication has an auxiliary supply passage, which connects the discharge chamber with the crank chamber. The auxiliary supply passage supplies refrigerant gas to the crank chamber from the discharge chamber when the amount of blowby gas to the crank chamber is insufficient. Even if the inlet valve body contacts the valve seat to completely close the main supply passage, the crank chamber is connected to the discharge chamber by the auxiliary supply passage. Although the main supply passage and the auxiliary supply passage have the same function of supplying refrigerant gas from the discharge chamber to the crank chamber, the supply passages are independent. This complicates the machining of the housing and increases the costs.

Also, a rod that serves as a sliding guide for supporting the inlet valve body complicates the structure of the control valve and is not suitable for mass production.

Since the rod and the outlet valve body are movable parts, the contacting portions of the surface of the rod and the outlet valve body preferably slide smoothly relative to each other. Also, when the outlet valve body contacts the corresponding valve seat, the rod and the outlet valve body preferably form an effective seal. However, the rod and the outlet valve body violently slide relative to each other. Therefore, even if the machining accuracy and slide resistance are improved, the sealing effectiveness between the outlet valve body and the rod will not be sufficient. An inadequate seal effectiveness causes gas to leak from the crank chamber to the suction chamber. Hence, the crank pressure Pc cannot be accurately controlled.

The axial length of the outlet valve body may be increased such that the outlet valve body is cylindrical. This will improve the sealing effectiveness between the outlet valve body and the rod but will increase the weight of the outlet valve body. Increasing the weight of the outlet valve body deteriorates the performance of the outlet valve.

SUMMARY OF THE INVENTION

Accordingly, it is an objective of the present invention to provide a displacement control valve that has a simple structure and accurately controls the pressure in a crank chamber.

To achieve the above objective, the present invention provides a control valve for controlling the displacement of a variable displacement type compressor. The compressor includes a crank chamber, a suction pressure zone, the inner pressure of which is suction pressure, a discharge pressure zone, the inner pressure of which is discharge pressure, a bleed passage for bleeding gas from the crank chamber to the suction pressure zone, and a supply passage for supplying gas from the discharge pressure zone to the crank chamber. The control valve comprises a valve housing. An outlet valve portion is located on the bleed passage to control the opening of the bleed passage. An inlet valve portion is located on the supply passage to control the opening of the supply passage. A shaft-like transmission mechanism extends between the outlet valve portion and the inlet valve portion to connect the outlet valve portion to the inlet valve portion. The transmission mechanism moves axially. A through hole is located in the inlet valve portion to receive a part of the transmission mechanism. The through hole constitutes a part of the supply passage. A clearance is formed between the transmission mechanism and a surface that defines the through hole to constantly connect the discharge pressure zone to the crank chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A displacement control valve 50 according to a first embodiment of the present invention will now be described with reference to FIGS. 1 to 4. The control valve 50 is used in a swash plate type variable displacement compressor with a clutch.

Figure 1:
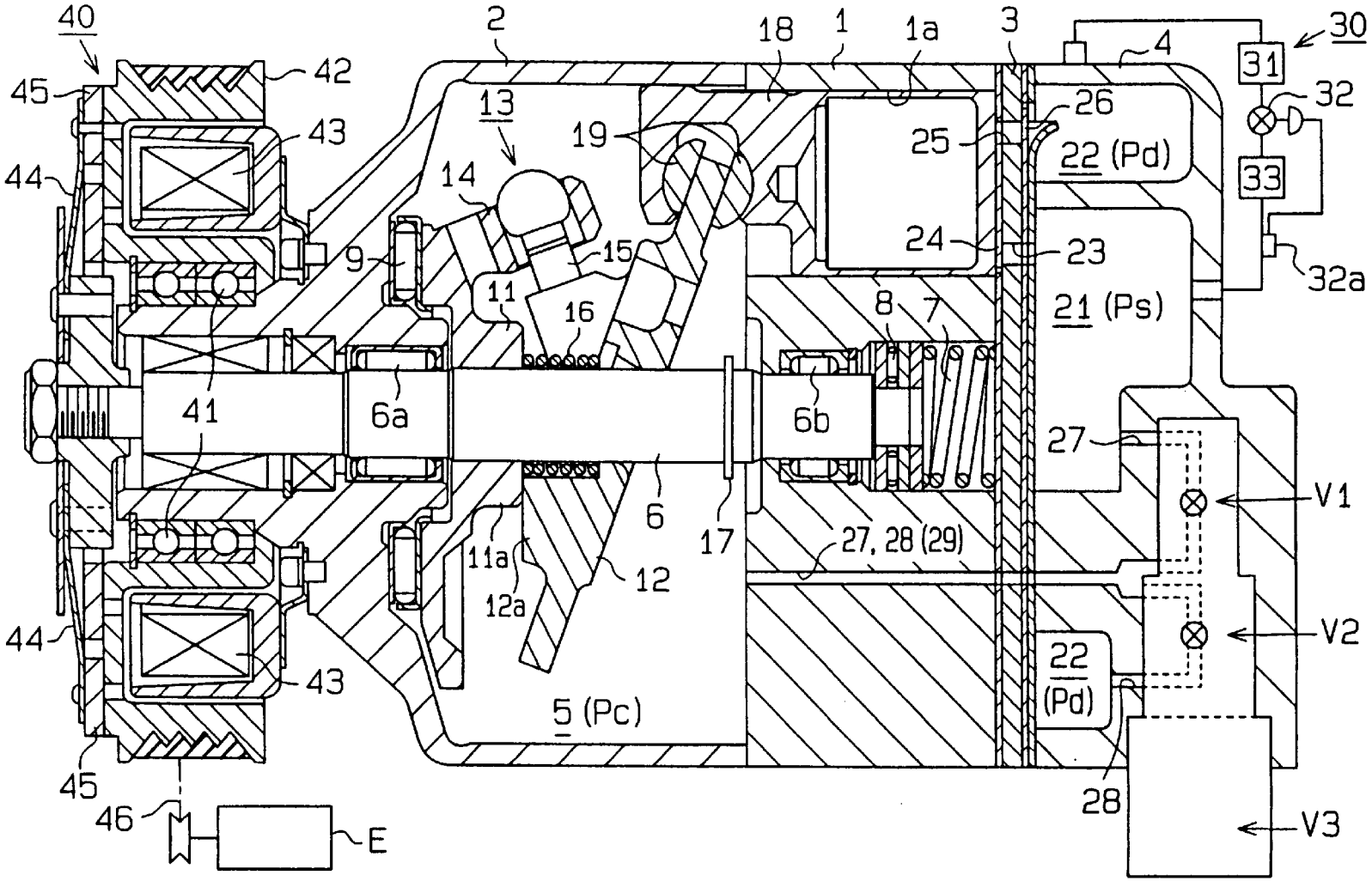
FIG. 1 is a cross-sectional view illustrating a swash plate type variable displacement compressor with an electromagnetic clutch according to a first embodiment.

As shown in FIG. 1, the compressor includes a cylinder block 1, a front housing member 2, which is secured to the front end face of the cylinder block 1, and a rear housing member 4, which is secured to the rear end face of the cylinder block 1. A valve plate 3 is located between the cylinder block 1 and the rear housing member 4. The cylinder block 1, the front housing member 2, the valve plate 3 and the rear housing member 4 are secured to one another by bolts (not shown) to form the compressor housing. In FIG. 1, the left end of the compressor is defined as the front end, and the right end of the compressor is defined as the rear end. A crank chamber 5 is defined between the cylinder block 1 and the front housing member 2. A drive shaft 6 extends through the crank chamber 5 and is supported through radial bearings 6*a*, 6*b* by the housing. A recess is formed in the center of the cylinder block 1. A coil spring 7 and a rear thrust bearing 8 are located in the recess. A lug plate 11 is secured to the drive shaft 6 to rotate integrally with the drive shaft 6. A front thrust bearing 9 is located between the lug plate 11 and the inner wall of the front housing member 2. The drive shaft 6 is supported in the axial direction by the rear bearing 8, which is urged forward by the spring 7, and the front bearing 9.

The front end of the drive shaft 6 is connected to a vehicle engine E, which serves as an external power source, through an electromagnetic clutch 40. The clutch 40 includes a pulley 42, an annular solenoid coil 43 and an armature 45. The armature 45 is coupled to the front end of the drive shaft 6. The pulley 42 is supported by the front portion of the front housing member 2 through a bearing 41. The armature 45 is supported by a leaf spring 44 to move in the axial direction of the drive shaft 6. In FIG. 1, the armature 45 contacts the pulley 42 against the force of the leaf spring 44.

When a current is supplied to the coil 43, an electromagnetic attraction force is generated between the armature 45 and the pulley 42. The electromagnetic force causes the armature 45 to contact the pulley 42. Accordingly, the force of the engine E is transmitted to the drive shaft 6 through a belt 46, the pulley 42 and the armature 45. When a current to the coil 43 is stopped, the armature 45 is separated from the pulley 42 by the force of the leaf spring 44, which disconnects the drive shaft 6 from the engine E. In this manner, the force of the engine E is selectively transmitted to the drive shaft 6 by controlling the current to the coil 43.

A swash plate 12 is located in the crank chamber 5. The swash plate 12 has a hole formed in the center. The drive shaft 6 extends through the hole in the swash plate 12. The swash plate 12 is coupled to the lug plate 11 by a hinge mechanism 13. The hinge mechanism 13 includes support arms 14 and guide pins 15. Each support arm 14 projects from the rear side of the lug plate 11 and has a guide hole. Each guide pin 15 projects from the swash plate 12 and has a spherical head. The support arms 14 and the guide pins 15 cooperate to permit the swash plate 12 to rotate integrally with the drive shaft 6. The swash plate 12 slides along the drive shaft 6 and tilts with respect to a plane perpendicular to the axis of the drive shaft 6.

A coil spring 16 is located between the lug plate 11 and the swash plate 12. The spring 16 urges the center of the swash plate 12 in the direction decreasing the inclination of the swash plate 12 (rightward in FIG. 1). A snap ring 17 is fixed on the drive shaft 6 behind the swash plate 12. When the swash plate 12 contacts the snap ring 17, the swash plate 12 is at the minimum inclination θmin, which is for example, three to five degrees. When a counter weight 12*a* of the swash plate 12 contacts a stopper 11*a* formed on the lug plate 11, the swash plate 12 is at the maximum inclination θmax.

Cylinder bores 1*a* (only one shown) are formed in the cylinder block 1. The cylinder bores 1*a* are arranged at equal angular intervals about the axis of the drive shaft 6. A single headed piston 18 is accommodated in each cylinder bore 1*a*. Each piston 18 is coupled to the swash plate 12 by a pair of shoes 19.

A suction chamber 21 and a discharge chamber 22 are defined between the valve plate 3 and the rear housing member 4. The discharge chamber 22 surrounds the suction chamber 21. The valve plate 3 has suction ports 23 and discharge ports 25, which correspond to each cylinder bore 1*a*. The valve plate 3 also has suction valve flaps 24, each of which corresponds to one of the suction ports 23, and discharge valve flaps 26, each of which corresponds to one of the discharge ports 25. The suction ports 23 connect the suction chamber 21 with the cylinder bores 1*a*. The discharge ports 25 connect the cylinder bores 1*a* with the discharge chamber 22.

Power of the engine E is transmitted to and rotates the drive shaft 6. Accordingly, the swash plate 12, which is inclined by an angle θ, is rotated. Rotation of the swash plate 12 reciprocates each piston 18 by a stroke that corresponds to the angle θ. As a result, refrigerant gas is drawn from the suction chamber 21, or a zone of suction pressure Ps, to each cylinder bore 1*a*. The gas is then compressed in the cylinder bore and discharged to the discharge chamber 22, or a zone of discharge pressure Pd. This process is repeated.

The inclination of the swash plate 12 is determined according to various moments acting on the swash plate 12. The moments include a rotational moment, which is based on the centrifugal force of the rotating swash plate 12, a spring force moment, which is based on the force of the spring 16, a moment of inertia of the piston reciprocation, and a gas pressure moment. The gas pressure moment is generated by the combination of the compression reaction force applied to the pistons 18, the force of the pressure in the cylinder bores 1*a* applied to the pistons 18 during their suction strokes, and the pressure in the crank chamber 5 (crank pressure Pc). The gas pressure moment reduces or increases the inclination of the plate 12 in accordance with the crank pressure Pc.

In the present embodiment, the gas pressure moment, the rotational moment and the moment of inertia and the spring force moment are balanced by adjusting the crank pressure Pc. Accordingly, the inclination of the plate 12 is adjusted to an angle between the maximum inclination θmax and the minimum inclination θmin. The stroke of each piston 18, or the displacement of the compressor, is adjusted in accordance with the inclination of the plate 12.

A bleeding passage 27 and a supply passage 28 are formed in the compressor housing. The bleeding passage 27 connects the crank chamber 5 with the suction chamber 21, and the supply passage 28 connects the crank chamber 5 with the discharge chamber 22. The mechanism for controlling the crank pressure Pc includes the bleeding passage 27, the supply passage 28 and a displacement control valve 50, which is located in the passages 27, 28. The upstream portion 27*a* of the bleeding passage 27 and the downstream portion 28*b* of the supply passage 28 form a common passage 29 between the control valve 50 and the crank chamber 5. The control valve 50 includes an outlet valve portion V1 and an inlet valve portion V2. The outlet valve portion V1 is located in the bleeding passage 27, and the inlet valve portion V2 is located in the supply passage 28.

The discharge chamber 22 is connected to the suction chamber 21 through an external refrigerant circuit 30. The external refrigerant circuit 30 and the compressor form a refrigeration circuit of a vehicle air-conditioning system. The external refrigerant circuit 30 includes a condenser 31, a temperature type expansion valve 32 and an evaporator 33. The opening of the expansion valve 32 is feedback-controlled based on the evaporation pressure and the temperature detected by a heat sensitive tube 32*a* at the outlet of the evaporator 33. The temperature near the outlet of the evaporator 33 represents the thermal load on the refrigeration circuit. The expansion valve 32 adjusts the supply of refrigerant to the evaporator 33 in accordance with the thermal load applied to the refrigeration circuit. This adjusts the flow rate of refrigerant in the external refrigerant circuit 30.

Figure 2:
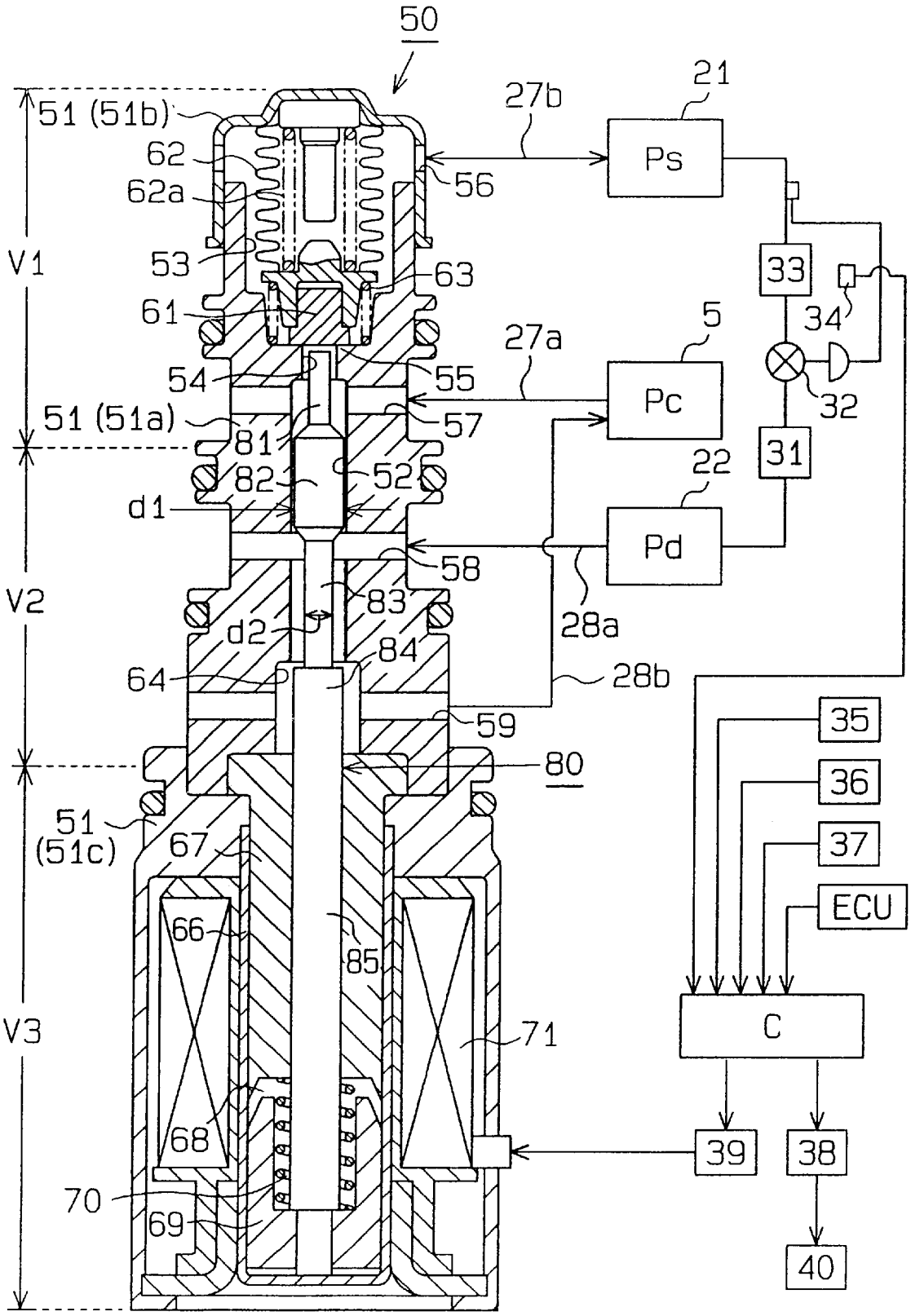
FIG. 2 is a cross-sectional view illustrating the displacement control valve in the compressor shown in FIG. 1.

As shown in FIG. 2, a temperature sensor 34 is located in the vicinity of the evaporator 33. The temperature sensor 34 detects the temperature of the evaporator 33 and sends the result to a controller C, which is a computer. The controller C controls the vehicle air-conditioning system. The input side of the controller C is connected to the temperature sensor 34, a passenger compartment temperature sensor 35, a temperature adjuster 36, which is used to set a target temperature of the passenger compartment, an operation switch 37, and an electronic control unit (ECU) of the engine E. The output side of the controller C is connected to a driving circuit 38, which controls the supply of current to the solenoid coil 43 of the electromagnetic clutch 40, and a driving circuit 39, which controls the supply of current to a solenoid portion V3 of the control valve 50.

The controller C controls the clutch 40 and the control valve 50 based on various information, which includes the temperature of the evaporator 33 detected by the temperature sensor 34, the temperature detected by the passenger compartment temperature sensor 35, the target temperature set by a temperature adjuster 36, ON/OFF state of the operation switch 37, and information from the ECU about the state of the engine E including the engine speed and whether the engine E is on or off. Specifically, the controller C computes an appropriate level of current supplied to the clutch 40 and the solenoid portion V3 of the control valve 50 based on the information. Then, a current of the computed level is supplied to the solenoid portion V3 from the driving circuit 39, which controls the opening size of the inlet valve portion V2 and a target pressure Pset of the outlet valve portion V1.

Figure 3:
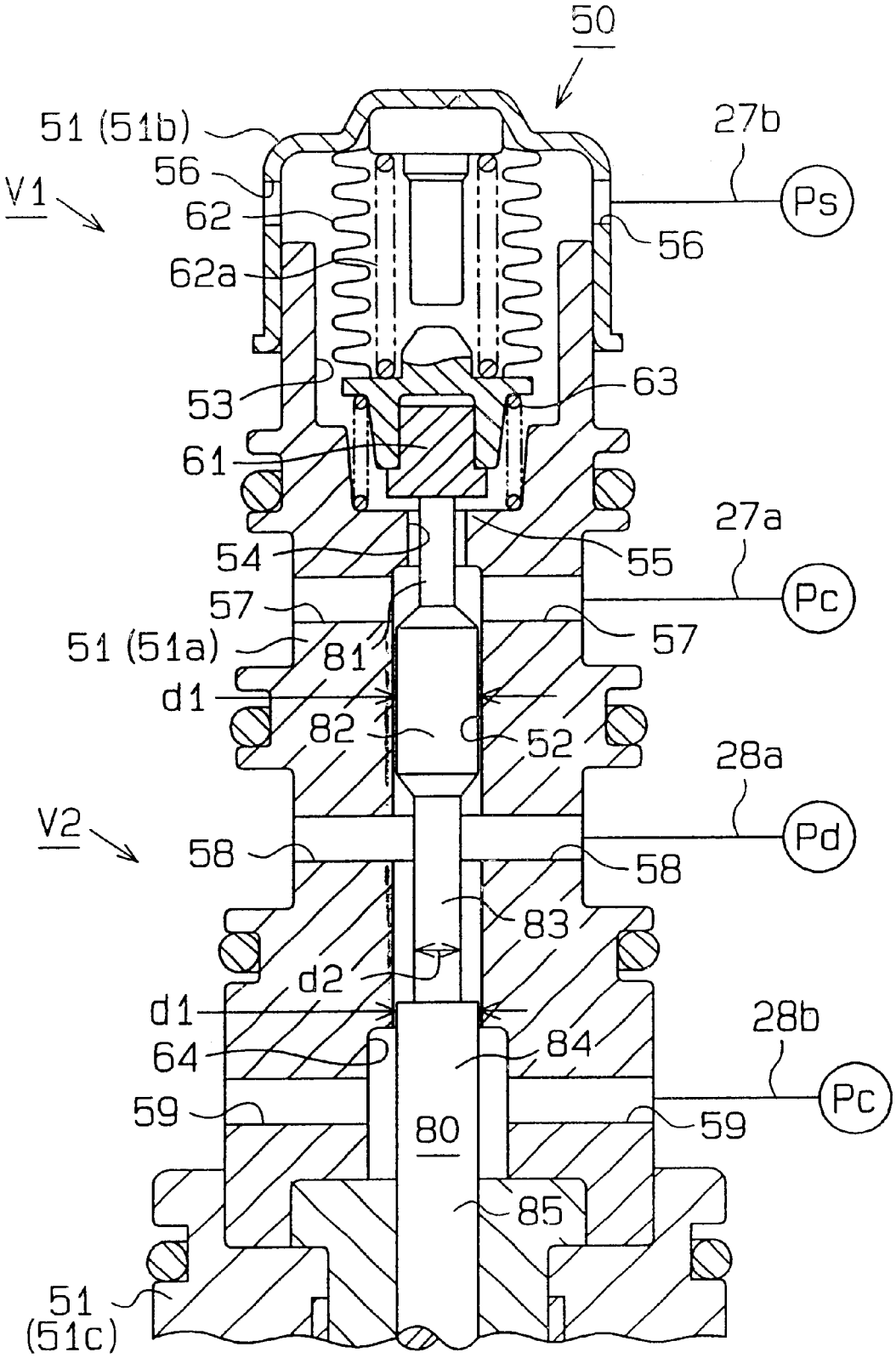
FIG. 3 is an enlarged partial cross-sectional view of the control valve shown in FIG. 2.

As shown in FIGS. 2 and 3, the outlet valve portion V1 is located in the upper portion of the valve 50, the inlet valve portion V2 is located in the center of the valve 50 and the solenoid portion V3 is located in the lower portion of the valve 50. The outlet valve portion V1 controls the opening size of the bleeding passage 27, which connects the crank chamber 5 with the suction chamber 21. The inlet valve portion V2 controls the opening size of the supply passage 28, which connects the discharge chamber 22 with the crank chamber 5. The solenoid portion V3 is an electromagnetic actuator that displaces a transmission rod 80 in the control valve 50 based on current supplied from the driving circuit 39. The transmission rod 80 permits the opening of one of the outlet valve portion V1 and the inlet valve portion V2 to be controlled while the other is closed.

The transmission rod 80 has a circular cross-section and includes a distal portion 81, a separator 82, a first coupler 83, a valve body portion 84 and a proximal portion, which is a second coupler 85. The separator 82 and the second coupler 85 have the same outer diameter d1 and the same cross-sectional area S1. The outer diameter d2 of the distal portion 81 and the diameter of the first coupler 83 are smaller than the diameter d1. The diameter of the valve body portion 84 is only slightly smaller than the diameter d1 by a value Δd. In other words, the outer diameter of the valve body portion 84 is represented by an equation (d1−Δd) and the cross-sectional area of the valve body portion 84 is (S1−Δs).

The control valve 50 has a valve housing 51. The valve housing 51 includes an upper portion 51*a*, a cap 51*b* and a lower portion 51*c*. The upper portion 51*a* forms the housing of the outlet valve portion V1 and the inlet valve portion V2. The cap 51*b* is secured to the upper end of the upper portion 51*a*. The lower portion 51*c* forms the housing of the solenoid portion V3. A through hole 52 is formed axially in the center of the upper portion 51*a*. The through hole 52 receives the transmission rod 80 such that the transmission rod 80 can slide within the through hole 52. The inner diameter of the through hole 52 is substantially equal to the diameter d1 of the separator 82. The separator 82 divides the through hole 52 into an upper zone located in the outlet valve portion V1 and a lower zone located in the inlet valve portion V2. The separator 82 isolates, or seals, the upper and lower zones from each other.

As shown in FIG. 2, the outlet valve portion V1 includes the upper portion 51*a* and the cap 51*b*. An outlet valve chamber 53 is defined in the cap 51*b*. An annular step is formed in the outlet valve chamber 53. The step projects from the inner wall of the upper portion 51*a* toward the axis and serves as a valve seat 55. A valve hole 54 is formed in the center of the valve seat 55. The valve hole 54 connects the outlet valve chamber 53 with the upper zone of the through hole 52. Ps Ports 56 are formed in the cap 51*b*. The outlet valve chamber 53 is connected to the suction chamber 21 by the Ps ports 56 and the downstream portion 27*b* of the bleeding passage 27. The downstream portion 27*b* and the Ps ports 56 form a passage to apply suction pressure Ps from the suction chamber 21 to the outlet valve chamber 53. The outlet valve chamber 53 functions as a pressure sensing chamber.

First Pc ports 57 are formed in a part of the valve housing 51 that surrounds the upper zone of the through hole 52. The crank chamber 5 is connected to the upper zone of the through hole 52 and the valve hole 54 by the first Pc ports 57 and the upstream portion 27*a* of the bleeding passage 27. Therefore, the first Pc ports 57, the upper zone of the through hole 52, the valve hole 54, the outlet valve chamber 53 and the Ps ports 56 form part of the bleeding passage 27, which connects the crank chamber 5 with the suction chamber 21.

A bellows 62 and an outlet valve body 61 are located in the outlet valve chamber 53. The bellows 62 functions as a pressure sensing member that senses the suction pressure Ps. The interior of the bellows 62 is under vacuum, or low-pressure. A spring 62*a* is located in the bellows 62. A stationary end of the bellows 62 is fixed to a recess formed in the cap 51*b*. The spring 62*a* urges a movable end of the bellows downward. A holding spring 63 is located between the lower end of the bellows 62 and the valve seat 55. The springs 62*a*, 63 hold the bellows 62 between the cap 51*b* and the valve seat 55.

A recess is formed in the movable end of the bellows 62 to receive the outlet valve body 61. The valve body 61 is fixed to the recess. (Alternatively, the valve body 61 may slide with respect to the recess). The valve body 61, which is substantially cylindrical, is moved along the axis of the control valve 50. As shown in FIG. 2, when the lower face of the outlet valve body 61 contacts the valve seat 55, the valve hole 54 is completely closed. That is, the valve body 61 closes the bleeding passage 27. The bellows 62 expands and contracts in accordance with the suction pressure Ps, which is applied to the outlet valve chamber 53. The displacement of the bellows 62 causes the outlet valve body 61 to change the opening size of the valve hole 54, or the opening size of the bleeding passage 27.

When the valve body 61 contacts the valve seat 55 or immediately before the valve body 61 contacts the valve seat 55, the valve body 61 is exposed to the crank pressure Pc from below and the suction pressure Ps from above. During operation of the compressor, the crank pressure Pc is generally higher than the suction pressure Ps. Thus, the valve body 61 is urged toward the bellows 62 by the force based on the difference between the pressures Pc and Ps (Pc−Ps). The force of the bellows 62, which includes the spring 62*a*, is set to be normally greater than the force (Pc−Ps). Therefore, as long as the transmission rod 80 does not transmit force to the valve body 61, the outlet valve body 61 remains in contact with the valve seat 55.

The inlet valve portion V2 includes the lower zones of the through hole 52 and an inlet valve chamber 64 defined in the upper portion 51*a*. The inner diameter of the inlet valve chamber 64 is larger than the inner diameter d1 of the through hole 52. The inlet valve chamber 64 is located immediately below the through hole 52 and communicates with the lower zone of the through hole 52. The bottom of the inlet valve chamber 64 is formed by the upper face of a fixed core 67. Pd ports 58 are formed in a part of the valve housing 51 that surrounds the lower zone of the through hole 52. The lower zone of the through hole 52 is connected to the discharge chamber 22 through the Pd ports 58 and the upstream portion 28a of the supply passage 28. Second Pc ports 59 are formed in a part of the valve housing 51 that surrounds the inlet valve chamber 64. The second Pc port 59 and the downstream portion 28b of the supply passage 28 connect the inlet valve chamber 64 to the crank chamber 5. The Pd ports 58, the lower zone of the through hole 52, the inlet valve chamber 64 and the second Pc ports 59 are located in the inlet valve portion V2 and form part of the supply passage 28, which connects the discharge chamber 22 with the crank chamber 5.

As shown in FIG. 2, the valve body portion 84 of the transmission rod 80 is located in the inlet valve chamber 64. When the rod 80 is moved upward, the valve body portion 84 substantially closes the through hole 52 as shown in FIG. 3. The valve body portion 84 selectively opens and closes the through hole 52 to function as an inlet valve body that opens and closes the supply passage 28. The lower zone of the through hole 52 functions as a valve hole of the inlet valve portion V2.

The outer diameter (d1−Δd) of the valve body portion 84 is slightly smaller than the diameter d1 of the through hole 52. The valve body portion 84 therefore does not completely close the through hole 52. When the valve body portion 84 enters the through hole 52, a throttle is formed in the lower zone of the through hole 52. The size of the throttle corresponds to the difference Δd between the diameter d1 of the through hole 52 and the diameter of the valve body portion 84. In other words, the throttle is formed in the supply passage 28. The throttle functions as an auxiliary supply passage to supply refrigerant gas to the crank chamber 5 when the inlet valve portion V2 is closed.

As shown in FIG. 2, the solenoid portion V3 has a cup-shaped cylinder 66. The fixed core 67 is fitted in the cylinder 66. A solenoid chamber 68 is defined in the cylinder 66. A movable iron core 69, which serves as a plunger, is accommodated in the solenoid chamber 68 to move in the axial direction of the control valve 50. The second coupler 85 of the rod 80 extends through and moves relative to the center of the fixed core 67. The lower end of the second coupler 85 is fitted in a hole formed in the movable core 69 and fixed to the movable core 69 by crimping. The movable core 69 therefore moves integrally with the transmission rod 80.

A spring 70 is located between the fixed core 67 and the movable core 69. The spring 70 urges the movable core 69 away from the fixed core 67. When current is not being supplied to the valve portion V3, the spring 70 maintains the movable core 69 and the transmission rod 80 at the position shown in FIG. 2.

A coil 71 is located radially outside of the fixed core 67 and the movable core 69. The controller C commands the driving circuit 39 to supply a predetermined current to the coil 71. The coil 71 generates an electromagnetic force in accordance with the value I of the supplied current. The electromagnetic force causes the movable core 69 to be attracted to the fixed core 67, which moves the rod 80 upward.

When no current is supplied to the coil 71, the rod 80 is maintained at the position shown in FIG. 2 (an initial position) by the force of the spring 70. The distal portion 81 of the rod 80 is separated from the outlet valve body 61, and the valve body portion 84 of the rod 80 is separated from the lower zone of the through hole 52. At this time, the valve body 61 of the outlet valve portion V1 contacts the valve seat 55 to close the valve hole 54, and the inlet valve portion V2 is open.

When a current is supplied to the coil 71, upward electromagnetic force is generated. The generated force is greater than the downward force of the spring 70. As a result, the valve body portion 84 enters the through hole 52 as shown in FIG. 3, which permits the distal portion 81 to move the outlet valve body 61. In this state, the inlet valve portion V2 is closed and the lower zone of the through hole 52 functions as a throttle. In other words, the inlet valve portion V2 is an ON/OFF valve that is externally controlled.

When the distal portion 81 contacts the outlet valve body 61 and moves the valve body 61 upward, the bellows 62, which includes the spring 62*a*, the outlet valve body 61, the rod 80 and the solenoid portion V3 move integrally. As the rod 80 is moved upward, the valve body 61 is separated from the valve seat 55. The distance between the valve body 61 and the valve seat 55 represents the opening size of the valve hole 54. That is, electromagnetic force adjusted by the solenoid portion V3 changes a target suction pressure Pset of the outlet valve portion V1 against the force of the springs in the pressure sensing mechanism.

The operation of the above described variable displacement compressor will now be described.

When the switch 37 is turned off, the clutch 40 is disengaged and the compressor is stopped. In this state, the supply of electric current to the coil 71 of the control valve 50 is also stopped. When the compressor is stopped for a relatively long period, the pressures in the chambers 5, 21, 22 are equalized and the plate 12 is retained at the minimum inclination θmin.

When the switch 37 is turned on and the temperature detected by the temperature sensor 35 exceeds a target temperature set by the temperature adjuster 36, the controller C commands the driving circuit 38 to supply current to the electromagnetic clutch 40. This connects the compressor to the engine E and drives the compressor. The controller C also commands the driving circuit 39 to supply current to the coil 71 of the control valve 50.

In accordance with the value of current supplied to the coil 71, the transmission rod 80 is moved upward against the downward force of the spring 70. Then, the valve chamber 64 of the inlet valve portion V2 is closed, which causes the supply passage 28 to function as an auxiliary supply passage that has a throttle. The outlet valve portion V1 is connected to the solenoid portion V3 and the opening of the outlet valve portion V1 is controlled by the solenoid portion V3. The opening size of the outlet valve portion V1, or the position of the valve body 61 in the outlet valve chamber 53, is determined by the equilibrium of the force applied to the valve body 61 through the rod 80 and the downward force of the pressure sensing mechanism, which includes the bellows 62. The force of the pressure sensing mechanism represents the suction pressure Ps.

When the thermal load is great, the difference between the temperature detected by the temperature sensor 35 and the temperature set by the temperature adjuster 36 is great. The greater the temperature difference is, the greater electric current the controller C instructs the driving circuit 39 to supply to the coil 71 of the control valve 50. This increases attraction force between the fixed core 67 and the movable core 69 and strongly urges the transmission rod 80 upward to increases the opening size of the valve hole 54. In other words, as the supply of electric current increases, the control valve 50 increases the opening size of the outlet valve portion V1 to maintain a lower suction pressure (target suction value). As a result, the amount of gas flowing out of the crank chamber 5 increases.

On the other hand, the inlet valve portion V2, or the inlet valve chamber 64, is closed. In this state, the amount of gas flowing out of the crank chamber 5 becomes relatively high and the crank pressure Pc is lowered. If the thermal load is great, the pressure in the cylinder bores 1*a*, or the suction pressure Ps, is relatively high and the difference between the suction pressure Ps and the crank pressure Pc is relatively small. Accordingly, the inclination of the swash plate 12 is increased, which increases the compressor displacement.

When the inclination of the swash plate 12 is θmax and the compressor displacement is maximum, the discharge pressure Pd, which is applied to the lower zone of the through hole 52, differs greatly from the crank pressure Pc in the inlet valve chamber 64. As a result, the separator 82 in the through hole 52 receives an upward force based on the difference (Pd−Pc) between the discharge pressure Pd and the crank pressure Pc, and the valve body portion 84 receives a downward force based on the pressure difference (Pd−Pc). The cross-sectional area of the separator 82 is substantially the same as the cross-sectional area (S1) of the valve body portion 84. Therefore, the force acting on the separator 82 and the valve body portion 84, which are connected by the first coupler 83, is represented by the following equation:

$$(Pd-Pc)\times S1-(Pd-Pc)\times S1=0$$

Therefore, changes of the pressures Pd and Pc do not affect the position of the rod 80, or the operation of the valve portions V1, V2.

When the thermal load is small, the difference between the temperature detected by the sensor 35 and the temperature set by the temperature adjuster 36 is small. The smaller the temperature difference is, the smaller the electric current is that the driving circuit 39 supplies to the coil 71. A reduction of the current reduces the attraction force between the fixed core 67 and the movable core 69 and reduces the force that urges the rod 80 upward, which reduces the opening size of the valve hole 54. Consequently, the bellows 62 operates the valve body 61 to raise the target suction pressure. In other words, as the supply of electric current decreases, the control valve 50 operates to maintain a higher suction pressure (target suction pressure).

When the opening size of the valve hole 54 is reduced, the amount of gas flowing out of the crank chamber 5 is less than the sum of the blowby gas from the cylinder bores 1*a* and the gas supplied to the crank chamber 5 through the auxiliary supply passage. Accordingly, the crank pressure Pc is increased. When the thermal load is small, the pressure of gas drawn into the cylinder bores 1*a*, or the suction pressure Ps, is also relatively low, which increases the difference between the suction pressure Ps and the crank pressure Pc. Therefore, the inclination of the swash plate 12 and the compressor displacement are decreased.

When the switch 37 is turned off or when the temperature of the evaporator 33 drops to a frost forming temperature, the controller C instructs the driving circuit 39 to stop current to the coil 71. If the current to the coil 71 is stopped and the electromagnetic force of the solenoid portion V3 disappears, the rod 80 is immediately moved back to the position of FIG. 2, or the initial position, by the force of the spring 70. Accordingly, the outlet valve portion V1 is closed and the inlet valve portion V2 is open. As a result, the flow rate of gas supplied to the crank chamber 5 from the discharge chamber 22 through the supply passage 28 is relatively high, which increases the pressure in the crank chamber 5 and immediately minimizes the inclination of the swash plate 12. The compressor thus operates at the minimum displacement. The same thing occurs when the engine E stalls and current to the air conditioning system is stopped.

Figure 4:
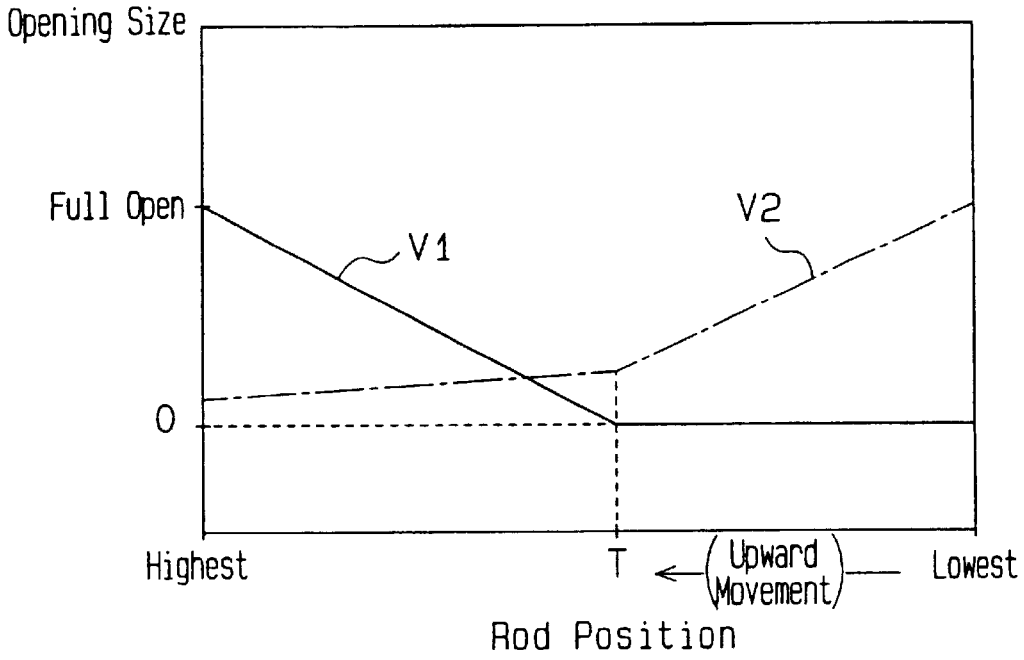
FIG. 4 is a graph showing the operational characteristics of the control valve shown in FIG. 2.
Figure 5:
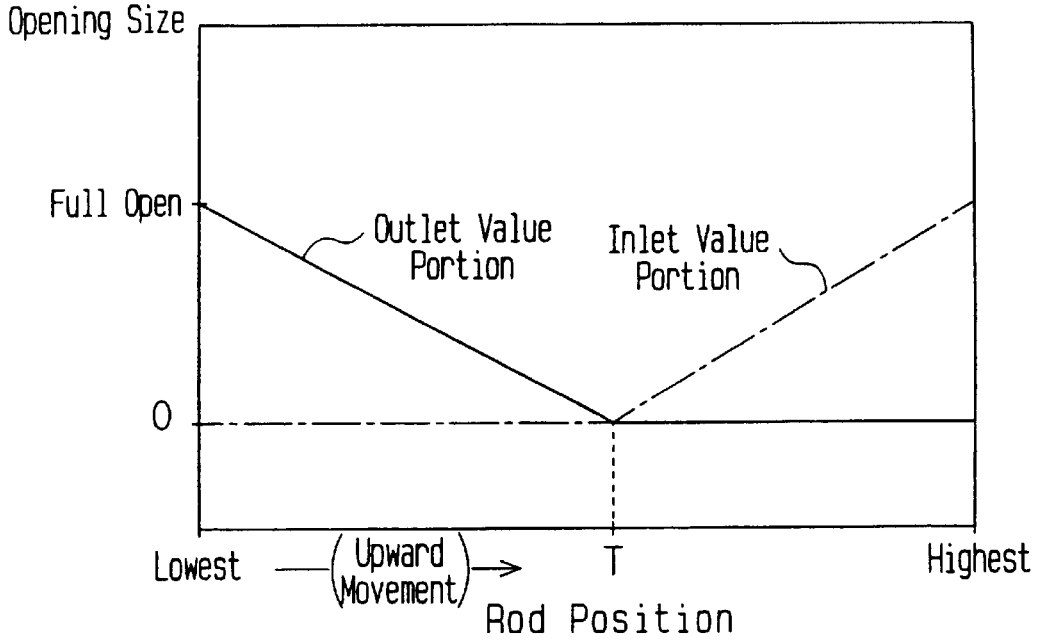
Fig.5(Prior Art)
FIG. 5 is a graph showing the operational characteristics of a prior art control valve.

FIG. 4 shows the operational characteristics of the outlet valve portion V1 and the inlet valve portion V2. The horizontal axis represents the axial position of the rod 80 in the control valve 50, and the vertical axis represents the opening size (throttle size) of the valve portions. FIG. 5 represents the operational characteristics of the outlet valve portion and the inlet valve portion of a prior art control valve (Japanese Unexamined Patent Publication No. 5-99136). The horizontal axis represents the axial position of the transmission rod, and the vertical axis represents the opening size (throttle size) of the valve portions.

In the control valve of FIG. 5, when the outlet valve portion (represented by solid line), which has an outlet valve body, is open, the inlet valve portion (represented by broken line), which as an inlet valve body, is closed. When the inlet valve portion is open, the outlet valve portion is closed. That is, when the rod is at a position T, the outlet valve body contacts a corresponding valve seat and closes the outlet valve portion, and the distal end of the rod starts moving an inlet valve body upward to open the inlet valve portion. In the prior art control valve of FIG. 5, the outlet valve portion and the inlet valve portion are simultaneously closed when the rod is at a certain position. In other words, the valve portions are not simultaneously open, but one of the valve portions is selectively open.

In the control valve 50 of FIG. 4, when the rod 80 is at a position T, the distal portion 81 of the rod 80 starts pressing the outlet valve body 61 upward and the valve body portion 84 starts entering the lower zone of the through hole 52. When the rod 80 is between the lowest position and the position T, the outlet valve portion V1 is closed and the inlet valve portion V2 is open. When the rod 80 is at the position T, the lower zone of the through hole 52 is switched from the main supply passage to the auxiliary supply passage, which has the throttle.

When the rod 80 is between the position T and the highest position, the outlet valve portion V1 is open. In this state, the inlet valve portion V2 is closed. However, the auxiliary supply passage stays open by the opening of the throttle. As the rod 80 moves from the position T to the highest position, the throttle size of the inlet valve portion V2 is gradually reduced. In other words, as the rod 80 is moved to the highest position, the throttle amount is increased.

The control valve 50 according to the first embodiment has the following advantages.

When the valve body portion 84 enters the lower zone of the through hole 52, the space between the through hole 52 and the valve body portion 84 functions as an auxiliary supply passage. This state corresponds to a state of the control valve of the Publication No. 5-99136. That is, in the prior art control valve, a throttle (an auxiliary supply passage) formed in the housing communicates the discharge chamber with the crank chamber when the inlet valve portion is closed. In the first embodiment of the present invention, the through hole 52, which is formed in the control valve 50, functions selectively as a main supply passage and an auxiliary supply passage having a throttle.

Only one movable member, namely the transmission rod 80, is located in the through hole 52, and no movable member is fitted about the rod 80. Therefore, the control valve 50 of the first embodiment is simple compared to the prior art control valve and is therefore suitable for mass production.

A zone exposed to the crank pressure Pc is referred to as a Pc zone, and a zone exposed to the suction pressure is referred to as a Ps zone. When the control valve 50 is functioning mainly as an inlet control valve, the outlet valve body 61 in the outlet valve portion V1 contacts the valve seat 55 and closes the bleeding passage 27. That is, the Pc zone and the Ps zone are completely disconnected from each other in the control valve 50. This prevents gas from leaking from the crank chamber 5 to the suction chamber 21 when the outlet valve portion V1 is closed.

The discharge pressure Pd is applied to the lower zone of the through hole 52, and the crank pressure Pc is applied to the upper zone of the through hole 52 and to the inlet valve chamber 64. Also, the outer diameter of the separator 82 of the rod 80 is substantially equal to the outer diameter of the valve body portion 84. Therefore, the force applied to the rod 80 by the discharge pressure Pd is equal to the force applied to the rod 80 by the crank pressure Pc. Therefore, the rod 80 is accurately controlled by an externally supplied current.

The rod 80 constantly disconnects the upper zone of the through hole 52 (Pc zone) from the lower zone (Pd zone) and selectively disconnects the lower zone of the through hole 52 (Pd zone) from the inlet valve chamber 64 (Pc zone). In this embodiment, the length of part of the valve body portion 84 that is in the through hole 52 is adjusted to control the amount of gas supplied to the crank chamber 5 through the auxiliary supply passage. Therefore, the amount of gas supplied to the crank chamber is easily controlled by adjusting the vertical stroke range of the rod 80 or by changing the length of the valve body portion 84.

Figure 6:
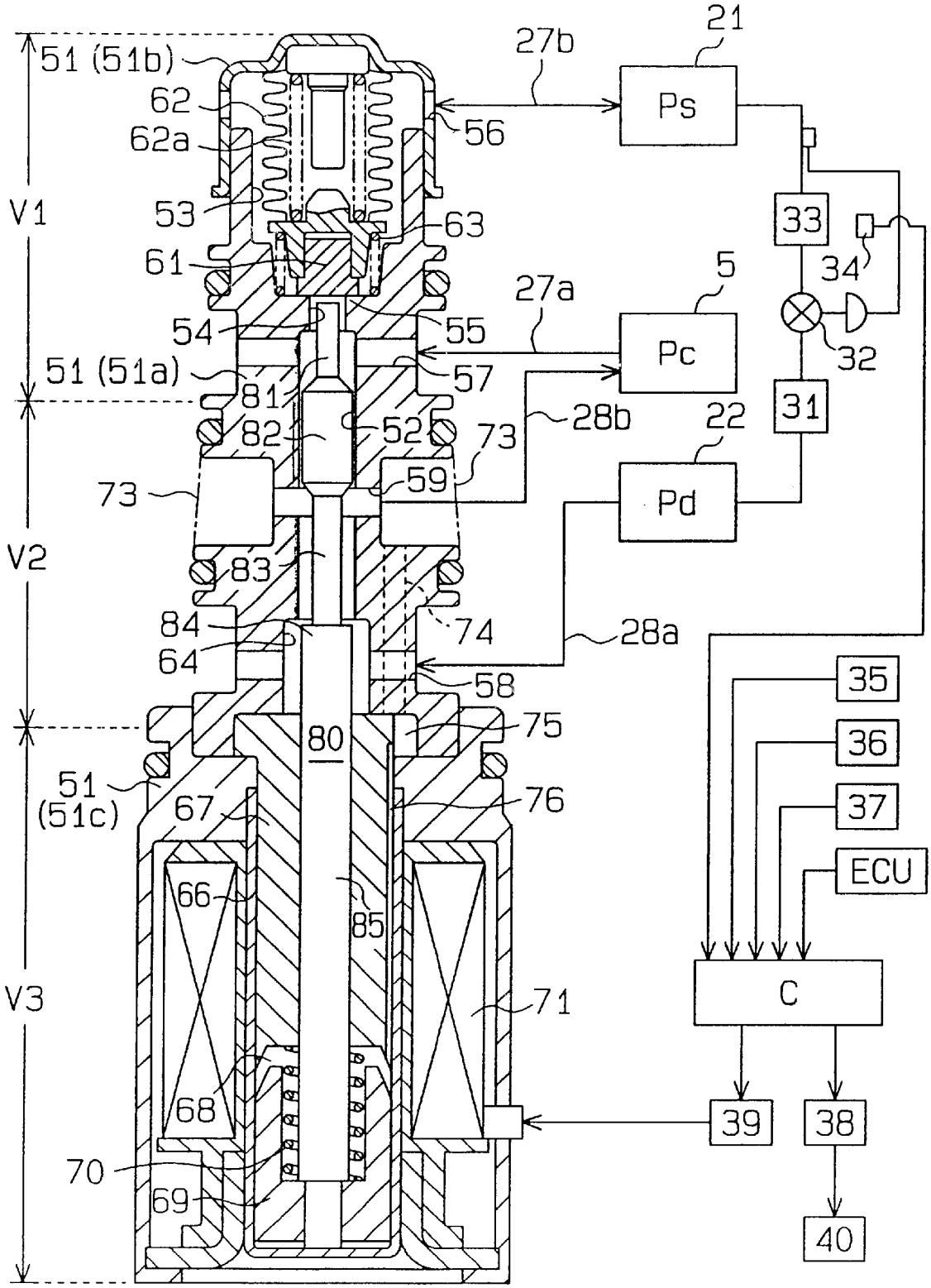
FIG. 6 is a cross-sectional view illustrating a displacement control valve according to a second embodiment.

FIG. 6 illustrates a control valve according to a second embodiment. The control valve of FIG. 6 is substantially the same as the control valve 50 of FIG. 2 except for the arrangement of the ports in the inlet valve portion V2 and the structure for equalizing the pressures acting on the transmission rod 80. The difference from the first embodiment will mainly be discussed below.

Second Pc ports 59 are formed in a part of the valve housing that surrounds the lower zone of the through hole 52. The lower zone of the through hole 52 is connected to the crank chamber 5 through the second Pc ports 59 and the downstream portion 28*b* of the supply passage 28. Pd ports 58 are formed in a part of the valve housing 51 that surrounds the inlet valve chamber 64. The inlet valve chamber 64 is connected to the discharge chamber 22 by the Pd ports 58 and the supply passage 28. That is, the locations of the ports of the inlet valve portion V2 shown in FIG. 6 are different from the locations of the ports of the inlet valve portion V2 shown in FIG. 2. In the control valve of FIG. 6, the flow direction of gas between the discharge pressure Pd and the crank pressure Pc is opposite to that of the control valve 50 shown in FIG. 2.

The control valve 50 of FIG. 6 has an annular chamber 73 defined by the compressor housing and the valve housing 51. The annular chamber 73 communicates with the second Pc ports 59 and is connected to the solenoid chamber 68 through a communication passage 74 and a space 75. The communication passage 74 is formed axially in the valve housing 51 and does not interfere with the Pd ports 58. The space 75 is defined by the fixed core 67 and the valve housing 51. A groove 76 is formed in the fixed core 67. The groove 76 connects the space 75 with the solenoid chamber 68. The communication passage 74, the space 75 and the groove 76 form a guide passage. The guide passage applies the crank pressure Pc to the solenoid chamber 68.

When the valve body portion 84 enters the lower zone of the through hole 52, the lower zone of the through hole 52 is connected to the solenoid chamber 68 through the second Pc ports 59, the annular chamber 73 and the guide passage. In this state, the crank pressure Pc is applied to the lower zone of the through hole 52 and the solenoid chamber 68. The valve body portion 84 and the second coupler 85 receive the crank pressure Pc from above and below. However, since the valve body portion 84 and the second coupler 85 have the same diameter and are formed integrally, the forces based on the crank pressure Pc are equalized.

The operational characteristics of the control valve of FIG. 6 are represented by FIG. 4. The control valve of FIG. 6 has the same advantages as the control valve 50 of FIG. 2.

Figure 7:
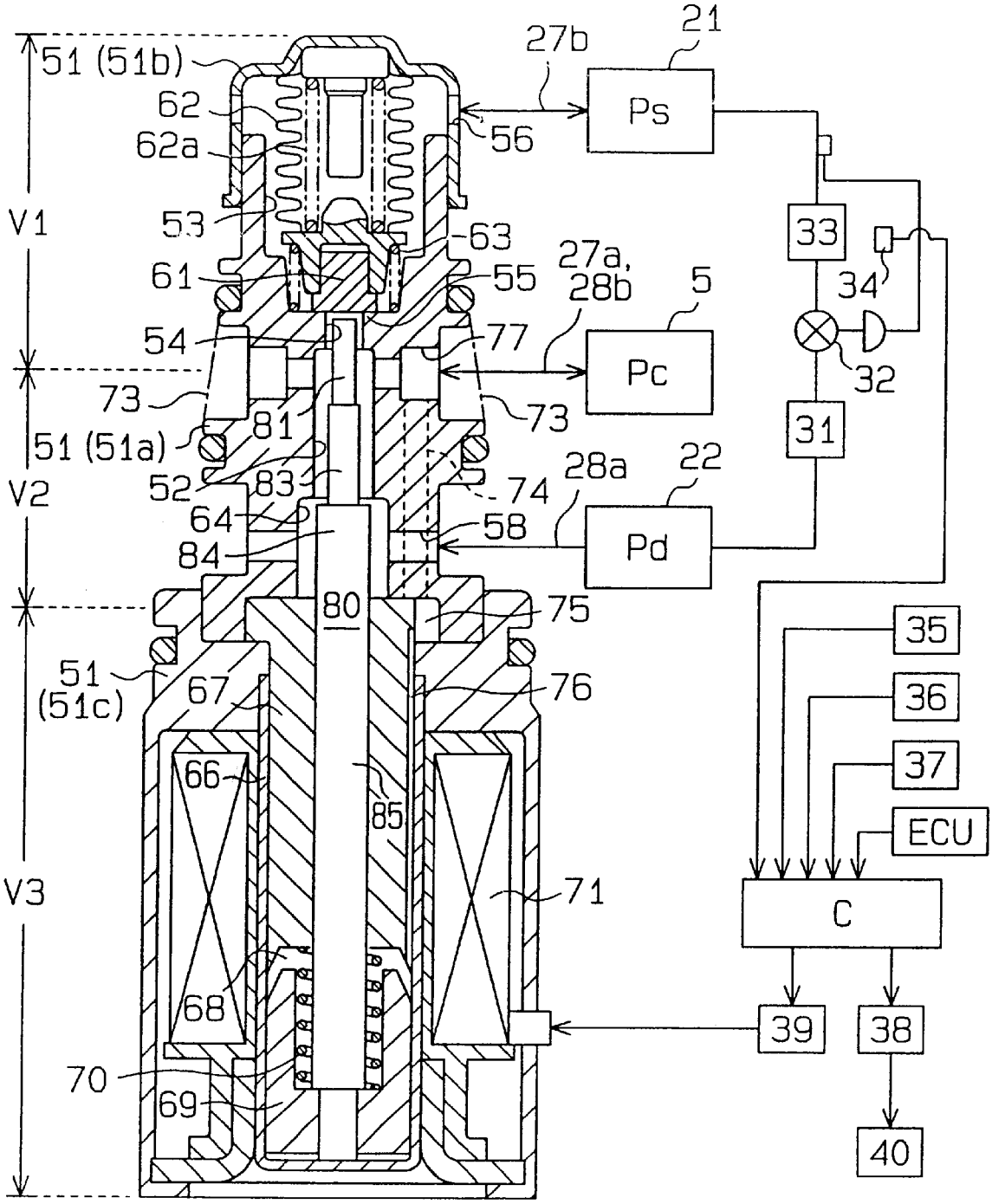
FIG. 7 is a cross-sectional view illustrating a displacement control valve according to a third embodiment.

FIG. 7 illustrates a control valve according to a third embodiment. Unlike the control valve of FIG. 6, the control valve of FIG. 7 does not have the separator 82 of the transmission rod 80. The first and second Pc ports 57, 59 of the control valve shown in FIG. 6 correspond to Pc ports 77. Other structure of the control valve shown in FIG. 7 is the same as that shown in FIG. 6.

A transmission rod 80 of the control valve shown in FIG. 7 includes a distal portion 81, a first coupler 83, a valve body portion 84 and a second coupler 85. The Pc ports 77 are formed in a part of a valve housing 51 that surrounds a through hole 52. The through hole 52 is connected to the crank chamber 5 by the Pc ports 77 and the common passage 29, which functions as the upstream portion 27*a* of the bleeding passage and the downstream portion 28b of the supply passage.

An annular chamber 73 is defined by the compressor housing and the valve housing 51 and is located adjacent to the Pc ports 77. The annular chamber 73 is connected to the solenoid chamber 68 by the guide passage, which includes the communication passage 74, the space 75, the groove 76 and the Pc ports 77. The guide passage applies the crank pressure Pc to the solenoid chamber 68. As in the case of the control valve shown in FIG. 6, the forces based on the crank pressure Pc acting on the rod 80 are equalized.

The operational characteristics of the control valve of FIG. 7 are represented by FIG. 4. The control valve of FIG. 7 has the same advantages as the control valves of FIGS. 2 and 6.

Figure 8:
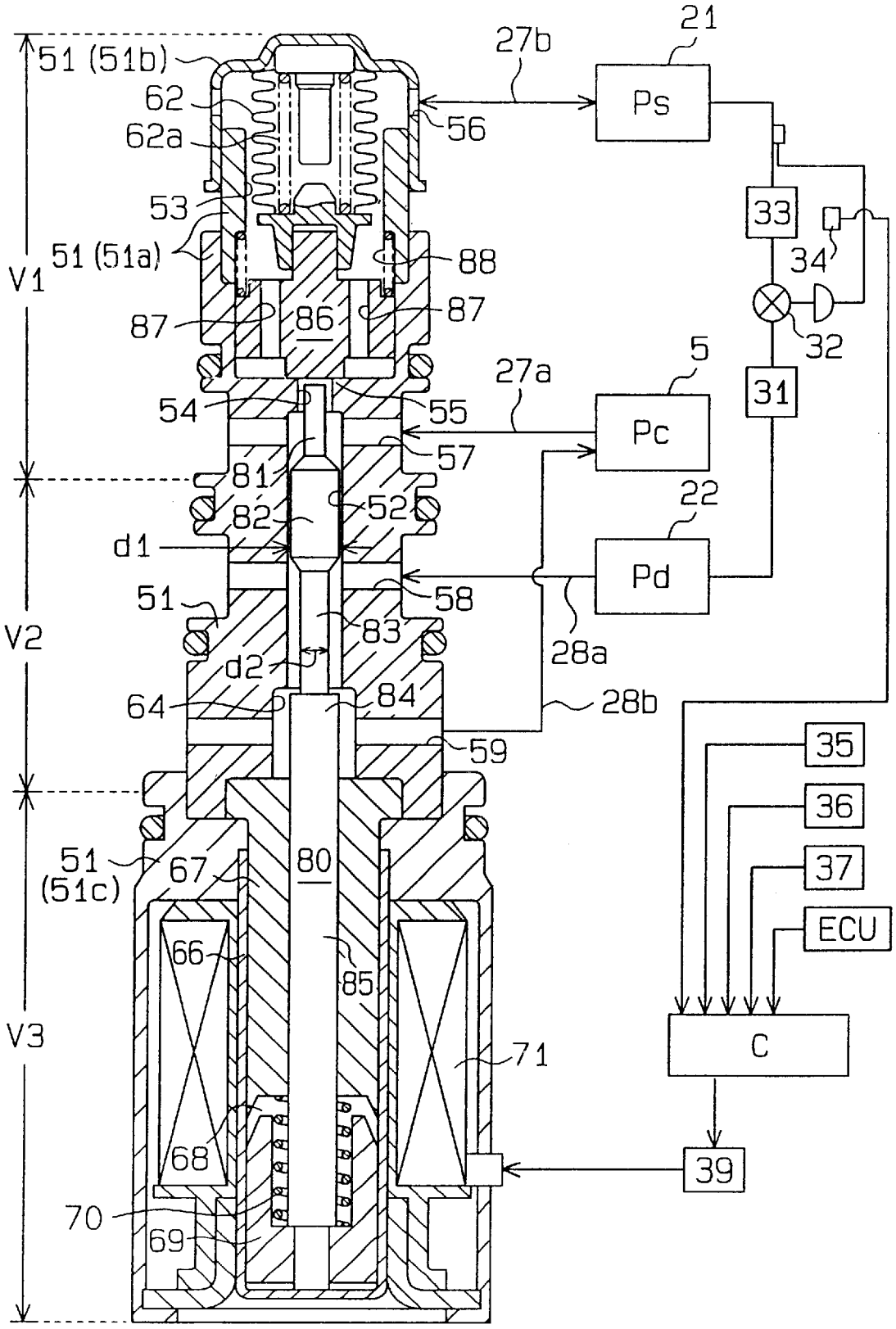
FIG. 8 is a cross-sectional view illustrating a displacement control valve according to a fourth embodiment.

The control valves shown in FIGS. 2, 6 and 7 are used in swash plate type variable displacement compressors with electromagnetic clutches. A control valve shown in FIG. 8 is used in a clutchless swash plate type variable displacement compressor. A clutchless type compressor does not have a clutch, and the power of the engine E is directly transmitted to the drive shaft 6. Therefore, the drive shaft 6 and the swash plate 12 continue to rotate as long as the engine E operates.

An outlet valve portion V1 of the compressor shown in FIG. 8 will now be described. The difference from the control valve shown in FIG. 2 will mainly be discussed below.

The control valve of FIG. 8 has an outlet valve chamber 53, which functions as the outlet valve chamber of an outlet valve portion V1. An outlet valve body 86 and a bellows 62 are located in the outlet valve chamber 53. The interior of the bellows 62 is under vacuum, or low-pressure. A spring 62*a* is located in the bellows 62. A stationary end of the bellows 62 is fixed to a recess formed in the cap 51*b*. The spring 62*a* urges a movable end of the bellows downward. A recess is formed in the distal end of the bellows 62. The recess faces a valve hole 54 formed in the center of the valve seat 55.

The outlet valve body 86 is movable along the axis of the outlet valve chamber 53. Through holes 87 are formed in the valve body 86 and extend in the axial direction of the valve body 86. The through holes 87 permit gas to flow between the upper portion and the lower portion of the outlet valve chamber 53. If the outer diameter of the valve body 86 is smaller than the diameter of the outlet valve chamber 53, the through holes 87 are not necessary.

The upper end of the valve body 86 is loosely fitted into the recess formed in the lower end of the bellows 62 such that the valve body 86 moves relative to the bellows 62. For example, when the bellows 62 contracts due to an increase of the suction pressure Ps and the lower end of the bellows 62 moves upward, the valve body 86 is not pulled by the bellows and maintains its position.

An annular step is formed in the outlet valve chamber 53. Also, an annular step is formed in the outlet valve body 86. A spring 88 is located between the annular steps to urge the outlet valve body 86 downward. When the difference between the crank pressure Pc and the suction pressure Ps is great, the force generated by the pressure difference is greater than the force of the spring 88. This sometimes causes the valve body 86 to instantaneously open the valve hole 54. That is, when the pressure difference is great, the outlet valve portion v1 functions as a differential valve to release the crank pressure Pc to the suction chamber 21.

The bellows 62 and the valve body 86 can move relative to each other, and the spring 88 causes the valve body 86 to contact the valve seat 55. Therefore, when the switch 37 is turned off and no current is supplied to the coil 71, the inlet valve portion V2 is open, which positively closes the outlet valve portion V1. In a clutchless type compressor, even if the thermal load is great and the pressure in the vicinity of the evaporator 33 is high, the control valve of FIG. 8 causes the swash plate 12 to move to the minimum inclination θmin, which minimizes the compressor displacement, when, for example, the switch 37 is turned off.

When a current is being supplied to the coil 71, electromagnetic force acting on the transmission rod 80 urges the valve body 86 upward against the force of the spring 88. Therefore, like the control valve 50 shown in FIG. 2, the outlet valve portion V1 of FIG. 8 changes the target suction pressure Pset based on an externally supplied current. The operational characteristics of the control valve shown in FIG. 8 are the same as those shown in FIG. 4. The control valve of FIG. 8 has the same advantages as the control valves of FIGS. 2, 6 and 7.

Figure 9:
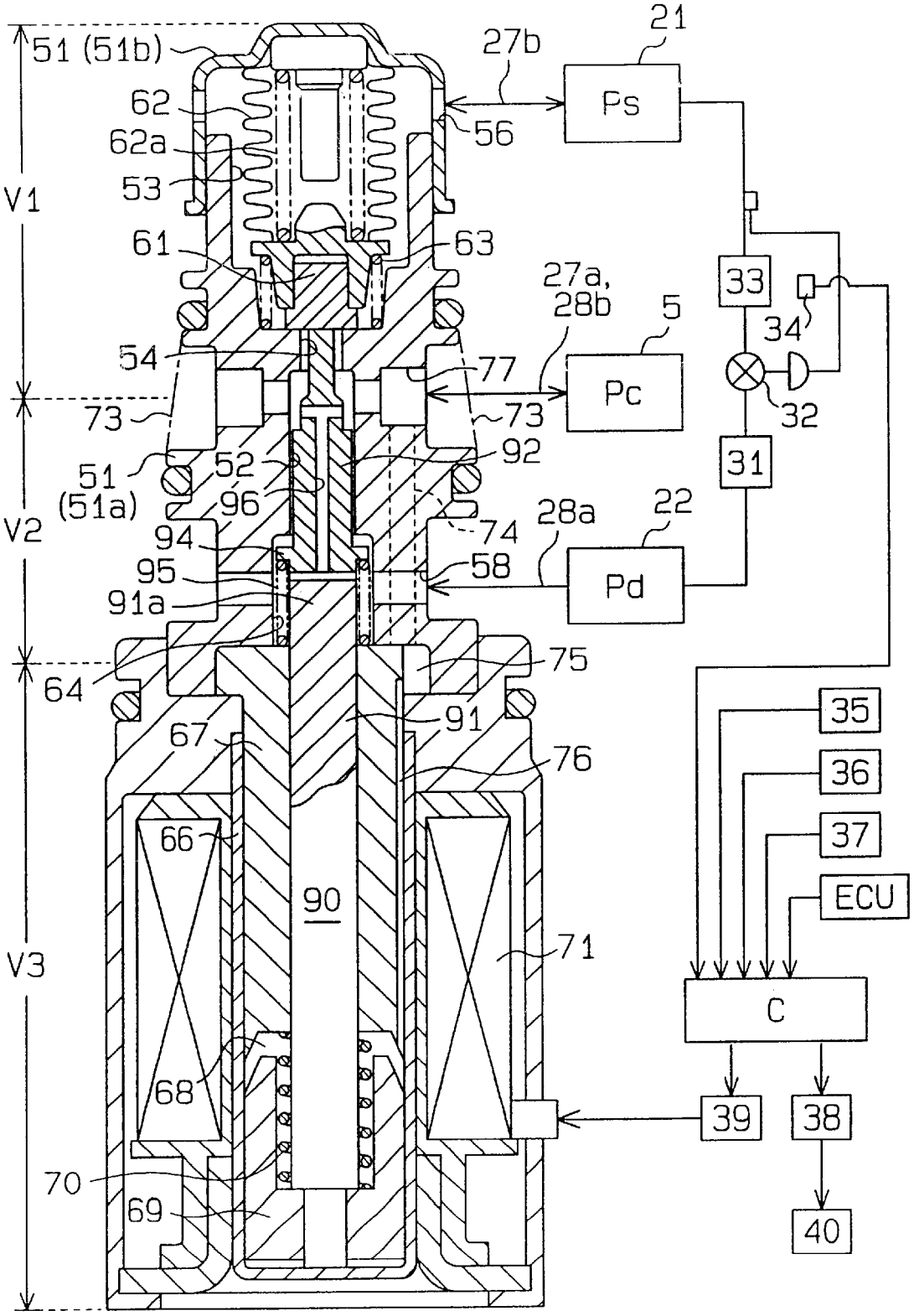
FIG. 9 is a cross-sectional view illustrating a displacement control valve according to a fifth embodiment.

The outlet valve portion V1 and the solenoid portion V3 of the control valve shown FIG. 9 are substantially the same as the corresponding portions of the control valve 50 shown in FIG. 2. The structures of the transmitter 90 and the inlet valve portion V2 are different from those of the control vale 50 shown in FIG. 2. Therefore, the difference from the control valve shown in FIG. 2 will mainly be discussed below.

The inlet valve portion V2 includes a through hole 52 and an inlet valve chamber 64. The through hole 52 extends axially in the valve housing 51. The inlet valve chamber 64 is formed immediately below the through hole 52. The upper end face of the fixed core 67 serves as the bottom of the valve chamber 64. The diameter of the inlet valve chamber 64 is greater than the diameter d1 of the through hole 52. Pc ports 77 are formed in a part of the valve housing 51 that surrounds the through hole 52. The Pc ports 77 communicate with the through hole 52. The Pc ports 77 are also connected to the crank chamber 5 by the common passage 29, which includes the upstream portion 27*a* of the bleeding passage 27 and the downstream portion 28*b* of the supply passage 28. Thus, the through hole 52 is connected to the crank chamber 5. Pd ports 58 are formed in a part of the valve housing 51 that surrounds the inlet valve chamber 64. The inlet valve chamber 64 is connected to the discharge chamber 22 by the Pd ports 58 and the upstream portion 28*a* of the supply passage 28.

Figure 10:
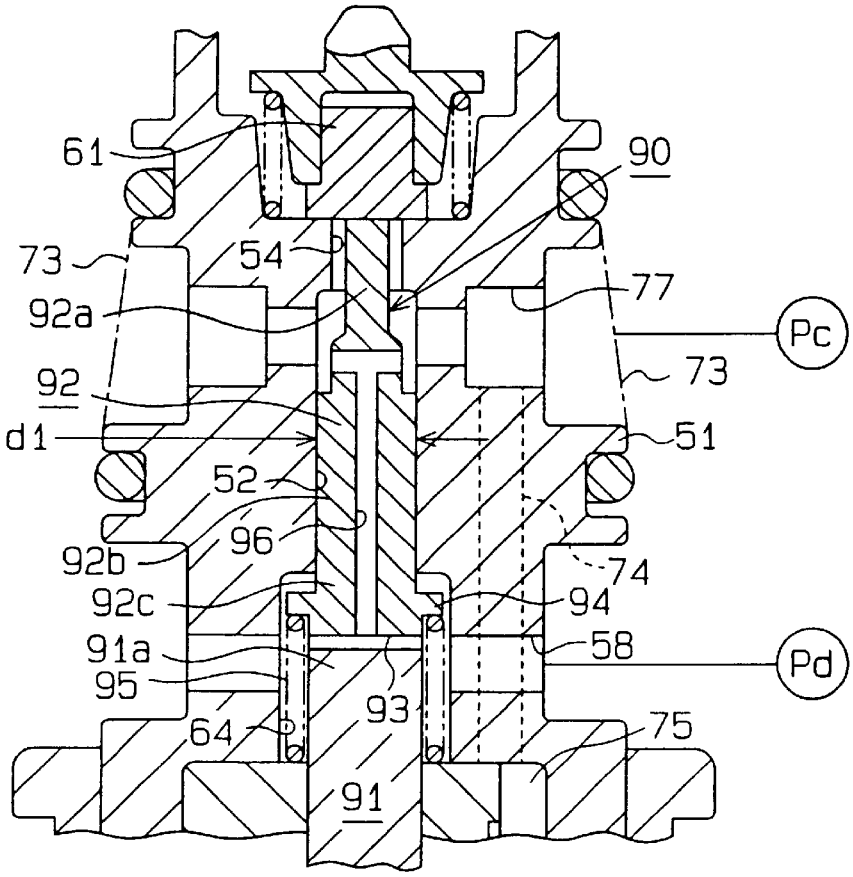
FIG. 10 is an enlarged partial cross-sectional view of the control valve shown in FIG. 9.

The transmitter 90 shown in FIGS. 9 and 10 includes the first rod 91 and the second rod 92, which contact and separate from each other. The lower end of the first rod 91 is located in the solenoid chamber 68 and fixed to the movable core 69. The first rod 91 moves integrally with the movable core 69. The valve body portion 91*a* of the first rod 91 is located in the inlet valve chamber 64. Like the valve body portion 84 shown in FIG. 2, the valve body portion 91*a* functions as a valve body. Instead of the first and second rods 91, 92, the transmitter 90 may include more than two rods or a cylinder and a rod. Alternatively, transmitter 90 may include more than two cylinders.

As shown in FIG. 10, the second rod 92 includes a distal end 92*a*, a middle portion 92*b* and a proximal portion 92*c*. The distal end 92*a* of the second rod 92 is located in the valve hole 54. When the second rod 92 moves upward, the distal end 92*a* moves the outlet valve body 61 upward. The middle portion 92*b* is located in the through hole 52 to move axially. The diameter of the middle portion 92*b* is only slightly smaller than the diameter d1 of the through hole 52 by a value Δd. In other words, the diameter of the middle portion 92*b* is represented by an equation (d1−Δd) and the cross-sectional area of the middle portion 92*b* is represented by an equation (S1−Δs). As in the case of the valve body portion 84 shown in FIG. 3, a space is formed between the middle portion 92*b* and the through hole 52 to function as a throttle.

The proximal portion 92*c* of the second rod 92 has a lower end face 93 and an annular projection 94, which functions as a valve seat. The lower end face 93 selectively contacts the valve body portion 91*a* of the first rod 91. A positioning coil spring 95 is located between the projection 94 and the bottom of the valve chamber 64. The spring 95 urges the second rod 92 upward such that the distal end 92*a* of the second rod 92 constantly contacts the lower face of the outlet valve body 61. That is, the spring 95 functions as a positioning means for defining the lowest position of the lower end face 93 of the second rod 92.

The spring 95 and the outlet valve body 61 constantly cause the second rod 92 to move according to the operation of the pressure sensing mechanism, which includes the bellows 62 of the outlet valve portion V1. The force of the spring 95 is less than the force of the pressure sensing mechanism of the outlet valve portion V1. For example, when the pressure sensing mechanism presses the outlet valve body 61 against the valve seat 55, the second rod 92 is at the lowest position shown in FIG. 9. Upward movement of the second rod 92 is limited by contact between the annular projection 94 and the upper wall of the inlet valve chamber 64. When the projection 94 contacts the upper wall of the valve chamber 64, the second rod 92 is at the highest position.

As shown in FIG. 10, a T shaped inner passage 96 is formed in the middle portion 92*b* and the proximal portion 92*c* of the second rod 92. Regardless the position of the second rod 92 in its movable range, the upper openings of the inner passage 96 communicate with the upper zone of the through hole 52, which communicates with the Pc ports 77. The lower opening of the inner passage 96 faces the upper face of the valve body portion 91*a*. When the upper face of the valve body portion 91*a* contacts the lower face of the second rod 92, the inner passage 96 is closed. The main supply passage 28 connects the discharge chamber 22 with the crank chamber 5. The Pd ports 58, the inlet valve chamber 64, the inner passage 96, the through hole 52 and the Pc ports 77 form part of the main supply passage 28 in the inlet valve portion V2 of the control valve of FIG. 9.

When the valve body portion 91*a* contacts the second rod 92, the main supply passage 28, which includes the inner passage 96, is closed. In this state, the space between the through hole 52 and the middle portion 92*b* of the second rod 92 function as an auxiliary passage having a throttle.

Like the control valve of FIG. 6, the control valve shown in FIGS. 9 and 10 has a guide passage (74, 75, 76). The guide passage connects the solenoid chamber 68 with the crank chamber Pc. As in the case of the control valve of FIG. 6, forces acting on the transmitter 90 based on the crank chamber Pc are equalized when the first rod 91 and the second rod 92 are integrally moved.

When current to the coil 71 is stopped, the first rod 91 is separated from the second rod 92 and is located at the lowest position shown in FIG. 9. Since the second rod 92 does not receive upward force from the first rod 91, the second rod 92 is moved to the lowest position by the pressure sensing mechanism. In this state, the outlet valve portion V1 is closed and the inlet valve portion V2 is open, which quickly increases the crank pressure Pc and moves the swash plate 12 to the minimum inclination θmin.

When a current is supplied to the coil 71, the first rod 91 contacts the lower end face 93 of the second rod 92 and moves integrally with the second rod 92. An electromagnetic force is generated in the solenoid portion V3 in accordance with the value of the supplied current. The electromagnetic force causes the first rod 91 to move the second rod 92 and the outlet valve body 61 upward against downward force of the pressure sensing mechanism. That is, when current is supplied to the coil 71, the outlet valve portion V1 functions as a control valve that changes a target suction pressure Pset. When the first rod 91 closes the inner passage 96, the main supply passage 28 is closed. Accordingly, the inlet valve portion V1 is closed. In this state, the small space between the second rod 92 and the through hole 52 functions as a part of the auxiliary supply passage to compensate for an insufficient supply of blowby gas.

Figure 11:
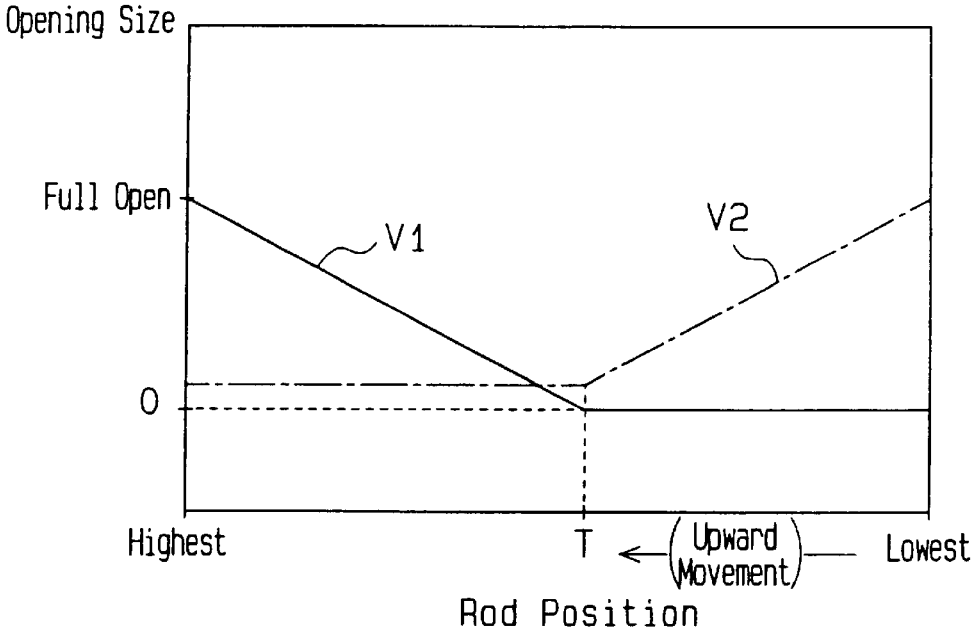
FIG. 11 is a graph showing the operational characteristics of the displacement control valve shown in FIGS. 9 and 10.

FIG. 11 shows the operational characteristics of the outlet valve portion V1 and the inlet valve portion V2 of the control valve shown in FIGS. 9 and 10. The horizontal axis represents the axial position of the transmitter 90 (particularly, the first rod 91), and the vertical axis represents the opening size (throttle size) of the valve portions. At a position T, the first rod 91 and the second rod 92 start contacting or separating. When the first rod 91 and the second rod 92 move integrally, or in the area between the highest position and the position T, the inlet valve portion V2 maintains a certain opening size.

In the control valve 50 shown in FIG. 2, the opening size of the inlet valve portion V2 decreases as the transmission rod 80 is moved from the position T to the highest position as shown in the graph of FIG. 4. In the control valve shown in FIGS. 9 and 10, the opening size of the inlet valve portion V2 is constant when the transmitter 90 is moved from the position T to the highest position. As in the previous embodiments, the space between the through hole 52 and the second rod 92 functions as a throttle of the auxiliary supply passage. The flow rate of gas flowing through the throttle is determined by the difference Δd between the diameter d1 of the through hole 52 and the diameter of the second rod 92.

The control valve of FIGS. 9 and 10 has the same advantages as the control valve 50 of FIG. 2.

Figure 12:
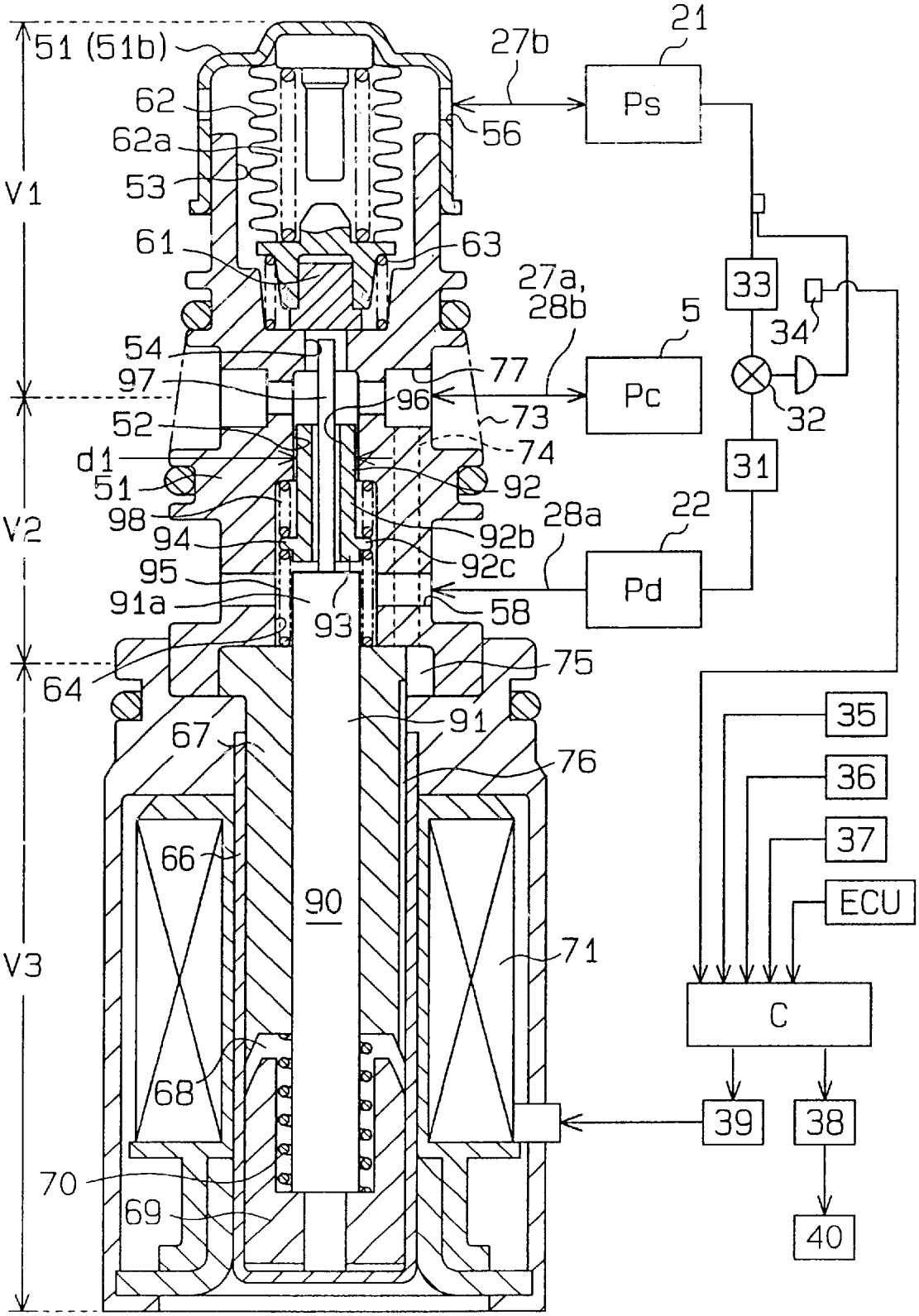
FIG. 12 is a cross-sectional view illustrating a displacement control valve according to a sixth embodiment.

FIG. 12 illustrates a control valve according to a sixth embodiment. The control valve of FIG. 12 is substantially the same as the control valve of FIGS. 9 and 10 except for the shapes of first and second rods 91, 92, which form a transmitter 90, and the structure of positioning means for defining the lowest position of the second rod 92. Therefore, the differences from the control valve shown in FIGS. 9 and 10 will mainly be discussed below.

The second rod 92 includes a middle portion 92*b* located in the through hole 52, a proximal portion 92*c*, and an axially extending inner passage 96. An annular projection 94 is formed on the proximal portion 92*c*. The outer diameter of the middle portion 92*b* is slightly smaller than the diameter d1 of the through hole 52 by an amount Δd. The space between the through hole 52 and the middle portion 92*b* functions as a throttle of the auxiliary supply passage.

The second rod 92 is supported in the through hole 52 and the inlet valve chamber 64 by first and second springs 95 and 98. The first spring 95 is located between the projection 94 and the bottom of the inlet valve chamber 64 to urge the second rod 92 upward. The second spring 98 is located between the projection 94 and the upper wall of the inlet valve chamber 64 to urge the second rod 92 downward. When the second rod 92 does not contact the first rod 91, the lowest position of the second rod 92 is determined by the forces of the springs 95, 98. In other words, the projection 94 and the first and second springs 95, 98 function as the positioning means for defining the lowest position of the second rod 92. The highest position of the second rod 92 is defined by the minimum length of the second spring 98. That is, when the first rod 91 moves the second rod 92 upward and the spring 98 cannot contract any further, the second rod 92 is at the highest position.

The first rod 91 shown in FIG. 12 has a transmission portion 97, which extends from the valve body portion 91*a*. The transmission portion 97 extends through the inner passage 96. The distal end of the transmission portion 97 is located in the valve hole 54. The diameter of the transmission portion 97 is smaller than the diameter of the inner passage 96. A passage having an annular cross section is defined between the wall of the inner passage 96 and the transmission portion 97. The passage function as a part of the main supply passage 28.

When current to the coil 71 is stopped, the first rod 91 is separated from the second rod 92 and is moved to the lowest position shown in FIG. 12. The transmission portion 97 is also separated from the outlet valve body 61. In this state, the outlet valve portion V1 is closed, and the inlet valve portion V2 is open. Accordingly, the crank pressure Pc is quickly increased, which moves the swash plate 12 to the minimum inclination θmin.

When current is supplied to the coil 71, the first rod 91 contacts the lower end face 93 of the second rod 92 and the first and second rods 91, 92 move integrally. The distal end of the transmission portion 97 contacts the lower face of the outlet valve body 61. An electromagnetic force is generated in the solenoid portion V3 in accordance with the value of the supplied current. The electromagnetic force causes the first rod 91 to move the second rod 92 and the outlet valve body 61 upward against downward force of the pressure sensing mechanism. That is, when current is supplied to the coil 71, the outlet valve portion V1 functions as a control valve that changes a target suction pressure Pset. The valve body portion 91*a* of the first rod 91 closes the inner passage 96, which closes the main supply passage 28. In other words, the inlet valve portion V1 is closed. In this state, the small space between the second rod 92 and the through hole 52 functions as a part of the auxiliary supply passage to compensate for an insufficient supply of blowby gas.

The control valve of FIG. 12 has the same advantages as the control valve of FIG. 9. The control valve of FIG. 12 has the same operational characteristics as the control valve of FIG. 11.

Figure 13:
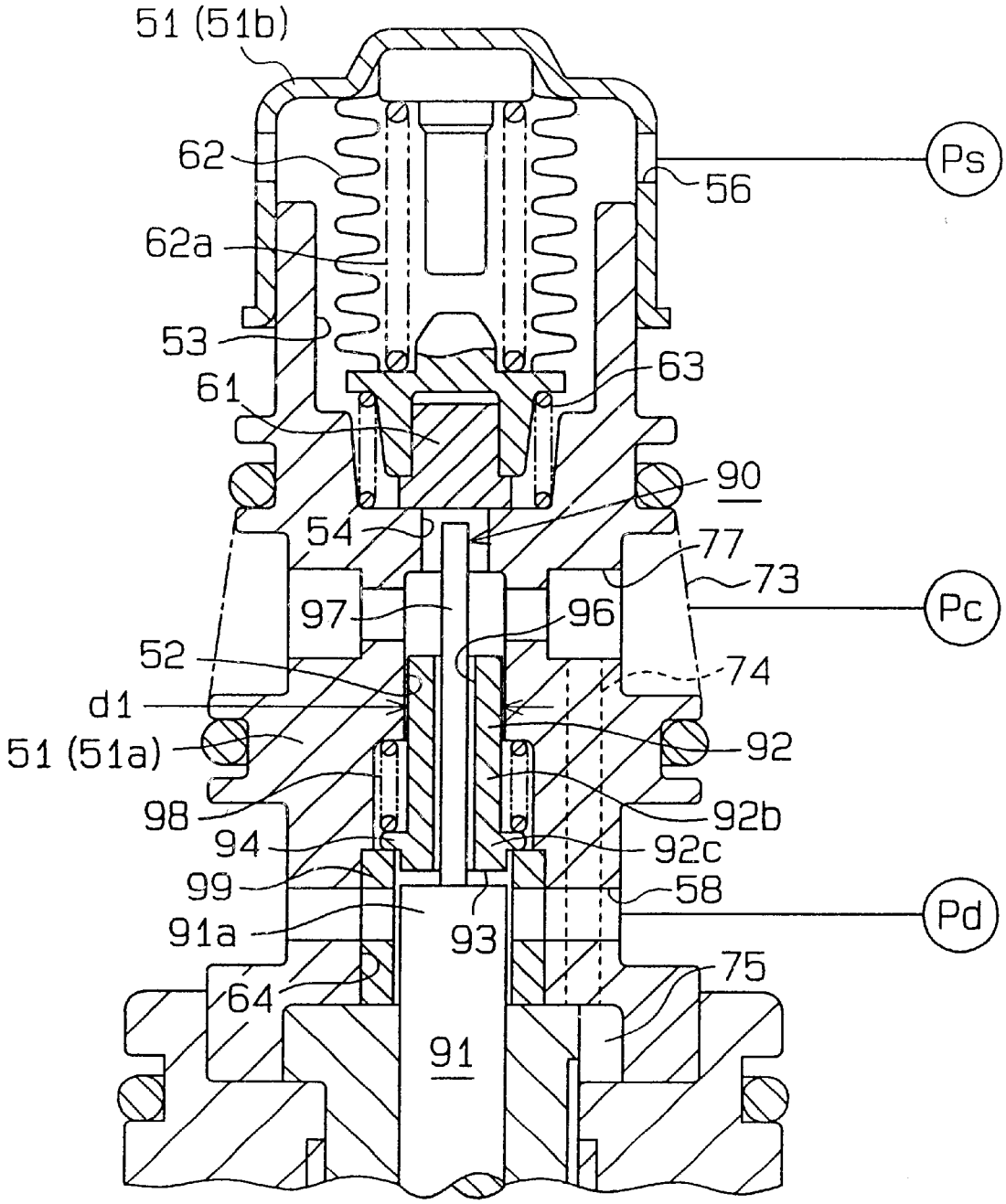
FIG. 13 is a cross-sectional view illustrating a displacement control valve according to a seventh embodiment.

FIG. 13 illustrates a control valve in accordance with a seventh embodiment. The control valve of FIG. 13 is substantially the same as the control valve of FIGS. 12 except for the structure of positioning means for defining the lowest position of the second rod 92. Therefore, the difference from the control valve shown in FIG. 12 will mainly be discussed below.

A cylindrical stopper 99 is secured in the lower portion of the inlet valve chamber 64. The upper end of the stopper 99 forms an annular step in the valve chamber 64. A coil spring 98 is located between the annular projection 94 and the ceiling of the valve chamber 64 to urge the projection 94 against the step formed by the stopper 99. The annular projection 94, the spring 98 and the stopper 99 function as positioning means for defining the lowest position of the lower end face 93 of the second rod 92. Compared to the positioning means of FIG. 12, the positioning means of FIG. 13, which includes the stopper 99, accurately defines the lowest position of the second rod 92. The highest position of the second rod 92 is defined by the shortest length of the second spring 98. That is, when the first rod 91 moves the second rod 92 upward and the spring 98 cannot contract any further, the second rod 92 is at the highest position.

The control valve of FIG. 13 has the same advantages as the control valve of FIG. 12. The control valve of FIG. 13 has the same operational characteristics as the control valve of FIG. 11.

The illustrated embodiment may be modified as follows.

A diaphragm may be used as the pressure sensing member in the outlet valve portion V1.

The outlet valve portion V1 of the control valves shown FIGS. 6, 7, 9, 12 and 13 may be replaced by the outlet valve portion shown in FIG. 8.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A control valve for controlling the displacement of a variable displacement type compressor, wherein the compressor includes a crank chamber, a suction pressure zone, the inner pressure of which is suction pressure, a discharge pressure zone, the inner pressure of which is discharge pressure, a bleed passage for bleeding gas from the crank chamber to the suction pressure zone, and a supply passage for supplying gas from the discharge pressure zone to the crank chamber, the control valve comprising:

a valve housing;

an outlet valve portion located on the bleed passage to control the opening of the bleed passage;

an inlet valve portion located on the supply passage to control the opening of the supply passage;

a shaft-like transmission mechanism extending between the outlet valve portion and the inlet valve portion to connect the outlet valve portion to the inlet valve portion, wherein the transmission mechanism moves axially; and a through hole located in the inlet valve portion to receive a part of the transmission mechanism, wherein the through hole constitutes a part of the supply passage, and wherein a clearance is formed between the transmission mechanism and a surface that defines the through hole to constantly connect the discharge pressure zone to the crank chamber.

2. The control valve according to claim 1, wherein the size of the clearance varies according to the axial position of the transmission mechanism.

3. The control valve according to claim 2, wherein the transmission mechanism has an inlet valve body, which is a part of the inlet valve portion, wherein the inlet valve body moves between a position where it enters the through hole and a position where it is separated from the through hole, wherein the clearance becomes small when the inlet valve body enters into the through hole and the clearance becomes large when the inlet valve body separates from the through hole.

4. The control valve according to claim 3, wherein the clearance functions as a throttle when the inlet valve body enters the through hole.

5. The control valve according to claim 3, wherein the transmission mechanism has a separator, which is always located in the through hole, wherein the separator divides the through hole into an outlet zone and an inlet zone, wherein the outlet zone constitutes a part of the bleed passage and the inlet zone constitutes a part of the supply passage.

6. The control valve according to claim 5 wherein inlet valve portion has an inlet valve chamber, which is connected to the inlet zone, wherein the inlet valve chamber is connected to the crank chamber through a downstream portion of the supply passage, wherein the outlet zone is connected to the discharge pressure zone through an upstream portion of the supply passage.

7. The control valve according to claim 6, wherein the cross sectional area of the inlet valve body is substantially the same as that of the separator.

8. The control valve according to claim 3, wherein the control valve has a solenoid to urge the transmission mechanism axially according to the supplied electric current, wherein the inlet valve body enters the through hole and the transmission mechanism opens the outlet valve portion when the electric current is supplied to the solenoid, and the transmission mechanism actuates the outlet valve portion by a force that depends on the supplied electric current.

9. The control valve according to claim 8, wherein the solenoid has an urging member, and the urging member urges the transmission mechanism in a direction opposite to the direction in which the solenoid urges the transmission mechanism, wherein the urging member moves the transmission mechanism such that the inlet valve body separates from the through hole and the outlet valve portion closes when the electric current is not supplied to the solenoid.

10. The control valve according to claim 1, wherein the transmission mechanism includes a first rod and a second rod, which contact and separate from each other, the control valve has a solenoid to urge the first rod against the second rod, the second rod is inserted into the through hole, and the clearance is formed between the second rod and the surface defining the through hole and functions as a throttle, the second rod has an inner passage that constitutes a part of the supply passage, the inner passage has an opening to face the first rod, the first rod has an inlet valve body that constitutes a part of the inlet valve portion, and the solenoid drives the first rod such that the inlet valve body selectively widens and narrows the opening.

11. The control valve according to claim 10, wherein the control valve has a stopper to limit movement of the second rod toward the first rod.

12. The control valve according to claim 10, wherein, when the electric current is supplied to the solenoid, the inlet valve body contacts the second rod to restrict the opening and the second rod opens the outlet valve portion, wherein the first rod actuates the outlet valve portion according to a force that depends on the supplied electric current to the solenoid.

13. The control valve according to claim 12, wherein the control valve has an urging member, and the urging member urges the first rod in the direction opposite to that in which the solenoid urges the first rod, wherein the urging member moves the first rod such that the inlet valve body separates from the through hole and the outlet valve portion closes when the electric current is not supplied to the solenoid.

14. The control valve according to claim 1, wherein the outlet valve portion includes:

an outlet valve body;

a sensing chamber located on the bleed passage, the sensing chamber being exposed to the suction pressure;

a sensing member located in the sensing chamber, wherein the sensing member moves the outlet valve body according to the suction pressure.

15. The control valve according to claim 14, wherein the outlet valve body moves independently from the sensing member, wherein the control valve further has an urging member to urge the outlet valve body in a direction opposite to the direction to close the bleed passage.

16. A control valve for controlling the displacement of a variable displacement type compressor, wherein the compressor includes a crank chamber, a suction pressure zone, the inner pressure of which is suction pressure, a discharge pressure zone, the inner pressure of which is discharge pressure, a bleed passage for bleeding gas from the crank chamber to the suction pressure zone, and a supply passage for supplying gas from the discharge pressure zone to the crank chamber, the control valve comprising:

a valve housing;

a transmission rod extending in the valve housing, wherein the transmission rod moves along its axis and has a distal end portion and a proximal end portion;

a solenoid located near the proximal end portion of the transmission rod, the solenoid urges the transmission rod axially by a force according to the supplied electric current;

an outlet valve portion located near the distal end portion of the transmission rod, wherein the solenoid actuates the outlet valve portion through the transmission rod to adjust the opening size of the bleed passage;

an inlet valve portion located between the solenoid and the outlet valve portion, wherein the inlet valve portion includes a through hole constituting a part of the supply passage and an inlet valve body formed on the transmission rod to enter the through hole, wherein the solenoid moves the transmission rod such that the inlet valve body selectively enters and separates from the through hole, and wherein, when the transmission rod enters the through hole, a throttle is formed between the transmission rod and a surface defining the through hole.

17. A control valve for controlling the displacement of a variable displacement type compressor, wherein the compressor includes a crank chamber, a suction pressure zone, the inner pressure of which is suction pressure, a discharge pressure zone, the inner pressure of which is discharge pressure, a bleed passage for bleeding gas from the crank chamber to the suction pressure zone, and a supply passage for supplying gas from the discharge pressure zone to the crank chamber, the control valve comprising:

a valve housing;

a through hole extending in the valve housing to constitute a part of the supply passage;

a solenoid driven by a supplied electric current;

a first rod extending in the valve housing to be moved axially by the solenoid, a distal end portion of the first rod having an inlet valve body;

a second rod located in the through hole to be substantially coaxial with the first rod, and wherein a throttle is formed between the second rod and a surface that defines the through hole, wherein the second rod has an inner passage to constitute a part of the supply passage, the inner passage has an opening facing the inlet valve body, and the solenoid moves the first rod axially such that the inlet valve body selectively widens and narrows the opening; and an outlet valve portion located in the bleed passage to control the opening size of the bleed passage, when the electric current is supplied to the solenoid the inlet valve body contacts the second rod to restrict the opening and the second rod opens the outlet valve portion, and wherein the first rod actuates the outlet valve portion according to the force that depends on the supplied electric current to the solenoid.

18. A control valve for controlling the displacement of a variable displacement type compressor, wherein the compressor includes a crank chamber, a suction pressure zone, the inner pressure of which is suction pressure, a discharge pressure zone, the inner pressure of which is discharge pressure, a bleed passage for bleeding gas from the crank chamber to the suction pressure zone, and a supply passage for supplying gas from the discharge pressure zone to the crank chamber, the control valve comprising:

a valve housing;

a transmission rod extending in the valve housing, wherein the transmission rod moves along its axis;

an outlet valve portion actuated by the transmission rod to adjust the opening size of the bleed passage; and an inlet valve portion, wherein the inlet valve portion includes a through hole constituting a part of the supply passage and an inlet valve body formed on the transmission rod, wherein the transmission rod moves such that the inlet valve body selectively enters and separates from the through hole.

19. The control valve according to claim 18, wherein the transmission rod moves the outlet valve portion while the inlet valve body enters the through hole.

20. The control valve according to claim 19, wherein the inlet valve body opens the supply passage when the inlet valve body separates from the through hole.

21. The control valve according to claim 20 further comprising a solenoid to urge the transmission rod axially according to the supplied electric current.

22. The control valve according to claim 21, wherein, when the electric current is supplied to the solenoid, the inlet valve body enters the through hole and the transmission rod opens the outlet valve portion, and the transmission rod actuates the outlet valve portion by a force that depends on the supplied electric current.

23. The control valve according to claim 22 further comprising an urging member for urging the transmission rod in a direction opposite to the direction in which the solenoid urges the transmission rod, wherein the urging member moves the transmission rod such that the inlet valve body separates from the through hole and the outlet valve portion closes when the electric current is not supplied to the solenoid.

* * * * *